US005624119A

United States Patent [19]

Leake

[11] Patent Number: 5,624,119

[45] Date of Patent: Apr. 29, 1997

[54] MULTIPLE VARIABLE GAME EQUIPMENT AND SYSTEM FOR GENERATING GAME FACES

[75] Inventor: Deborah L. Leake, Mars Hill, N.C.

[73] Assignee: Prisms, LLC, Asheville, N.C.

[21] Appl. No.: 427,434

[22] Filed: Apr. 24, 1995

[51] Int. Cl.[6] ..... A63F 3/06

[52] U.S. Cl. ..... 273/269; 463/19; 463/16; 463/40; 364/412; 283/49; 283/903; 273/139; 273/274

[58] Field of Search ..... 463/16, 19, 22, 463/30–31, 40–42; 364/410, 412; 273/237, 269, 274, 139, 293; 283/49, 903

[56] References Cited

U.S. PATENT DOCUMENTS

| | | | |
|---|---|---|---|
| Re. 34,368 | 9/1993 | Frain | 101/483 |
| 3,549,150 | 12/1970 | Weeks | 273/269 |
| 3,589,729 | 6/1971 | Girard | 273/269 |
| 4,019,744 | 4/1977 | Pizur, Sr. | 273/269 |
| 4,285,520 | 8/1981 | Small | 273/269 |
| 4,332,389 | 6/1982 | Loyd, Jr. et al. | 463/19 |
| 4,342,457 | 8/1982 | Small | 273/240 |
| 4,373,726 | 2/1983 | Churchill et al. | 463/19 |
| 4,444,103 | 4/1984 | Cronin | 101/72 |
| 4,448,127 | 5/1984 | Frain | 101/426 |
| 4,483,538 | 11/1984 | Koppen et al. | 273/270 |
| 4,611,811 | 9/1986 | Haase | 273/269 |
| 4,669,729 | 6/1987 | Solitt et al. | 463/19 X |
| 4,720,108 | 1/1988 | Gramera | 273/269 |
| 4,856,787 | 8/1989 | Itkis | 273/269 |
| 4,875,686 | 10/1989 | Timms | 273/269 |
| 4,882,688 | 11/1989 | Kondziolka et al. | 273/269 |
| 4,885,700 | 12/1989 | Kondziolka et al. | 273/269 |
| 4,909,516 | 3/1990 | Kolinsky | 273/269 |
| 4,999,001 | 3/1991 | Johnson, Jr. | 273/269 |
| 5,035,422 | 7/1991 | Berman | 273/269 |
| 5,072,381 | 12/1991 | Richardson et al. | 273/269 |
| 5,096,202 | 3/1992 | Hesland | 273/269 |
| 5,112,058 | 5/1992 | Sandeen | 273/269 |
| 5,127,656 | 7/1992 | Simpson | 273/269 |
| 5,160,146 | 11/1992 | Greer | 273/269 |
| 5,193,815 | 3/1993 | Pollard | 273/269 |
| 5,230,514 | 7/1993 | Frain | 273/269 |
| 5,242,163 | 9/1993 | Fulton | 463/19 |
| 5,265,880 | 11/1993 | Maksymec | 273/269 |
| 5,273,281 | 12/1993 | Lovell | 273/269 |
| 5,297,802 | 3/1994 | Pocock et al. | 273/269 |
| 5,351,970 | 10/1994 | Fioretti | 273/269 |
| 5,393,057 | 2/1995 | Marnell, II | 463/19 |

*Primary Examiner*—Jessica Harrison
*Assistant Examiner*—Mark A. Sager
*Attorney, Agent, or Firm*—Carter & Schnedler, P.A.

[57] ABSTRACT

Game systems, superficially similar to bingo, which employ combinations of multiple variables from different sets (for example colors; symbols such as numbers of letters; and geometric shapes such as circles, diamonds and squares) to increase the number of pattern permutations on individual game faces, in combination with random selection apparatus. Compared to ordinary bingo, the number of players may be greatly increased without resulting in games that are unduly short, and various version controls allow control over the mathematical probabilities of winning. Each game face has a plurality of individual positions organized as columns and rows. Within each column, the individual positions are filled with a random sequence of elements from each of at least two of the sets, and each column has a unique column designation. Random selection apparatus is disclosed, which is particularly useful when employed in combination with the game faces. The random selection apparatus generates a sequence of calls, where each call specifies an element from each of the at least two sets of different entities, for example a color and a number, such that a game player can designate individual positions on a particular game face which have elements that match the specified elements of a particular call. In addition, a call preferably includes a column designation. The random selection apparatus includes a number of random selectors, related to each other in a particular manner. Also disclosed are systems for generating game faces, and overall gaming systems.

54 Claims, 20 Drawing Sheets

MULTIPLE VARIABLE GAME EQUIPMENT AND SYSTEM FOR GENERATING GAME FACES

BACKGROUND OF THE INVENTION

The present invention relates generally to game systems, and, more particularly, to game systems which are superficially similar to bingo but which provide a number of significant advantages.

Very briefly, in ordinary bingo the basic elements are a set of game cards (one or several game cards for each player), and a random number generating device, such as an airball machine. Each playing card or game card has printed thereon a series of numbers, typically selected from the set of integer numbers from 1 through 75 (although other number sets may be employed), organized as five rows by five columns. The five columns are respectively designated "B", "I", "N", "G", and "O". On the printed game cards, within each column the five positions are filled with a random sequence of numbers from one-fifth of the total number set. Thus, for a number set from 1 through 75, the individual positions of the first column are filled with a sequence of numbers from the subset of integers from 1 through 15; the second column is filled with a sequence of numbers from the subset of integers from 16 through 30; the third column is filled with a sequence of numbers from the subset of integers from 31 through 45; the fourth column is filled with a sequence of integers from the subset of integers from 46 through 60; and the fifth column is filled with a sequence of numbers from the subset of integers from 61 through 75. Duplicate numbers do not appear within a column, (nor on an individual bingo game card in its entirety). Generally, the center position of the game card, that is the third position in the third row, is designated as a free space. Some number sequences are generally excluded as being unacceptable to bingo players; for example, a card in which the numbers "1-2-3-4-5" appear consecutively in a single column would not be permitted.

During the playing of a game of bingo, typically in a bingo hall where a number of players are assembled, a set of balls individually numbered from 1 through 75, and additionally bearing a redundant column designation "B", "I", "N", "G" or "O", are placed in an appropriate bin or hopper, for example of an airball machine. The game operator or "caller" specifies a shape or pattern to be formed on the game card. The balls are then randomly drawn or otherwise selected, and the column designation and number are "called" from each ball. (The redundant column designation is used only for rapid identification and location of the number, as the card column headings correspond to the number range to be located in each column.) With each call, players with the corresponding number on their game card "mark" the number position on their game card in an appropriate manner. The object of the game is to be the first player to have a set of randomly called numbers coincide with the marked numbers on the player's game card so as to form the specified shape or pattern. The winning shape or pattern varies depending upon the particular version of bingo being played. Examples of winning patterns include all five positions in a column, all five positions in a row, all five positions in either diagonal, all sixteen positions around the edge of the game card (a "frame"), and all positions on the entire card.

Although the total number of unique bingo card faces that can be generated employing the number set from 1 through 75 is a large number, calculated for example in Pocock et al U.S. Pat. No. 5,297,802 as $3005^5$=244,217,432,431,255,243, bingo card faces, are commonly printed in much smaller "lots" or "series", such as a series of 300, 600, 6,000, 9,000, 18,000, 36,000 or 72,000 unique card faces. (For the convenience of players, multiple card faces may be printed on a single sheet of paper, typically from two to eight card faces per sheet.) The card faces of a given "series" are carefully designed so that each number of the number set (for example the numbers from 1 through 75) appears on at least one of the cards of the series. Thus, during the playing of an actual game of bingo, the total number of card faces in the series is advantageously matched to the number of card faces actually being played so that, each time a number is called, at least one player is able to mark a card face.

Bingo, as typically implemented, proceeds relatively rapidly. While the duration of any given game of bingo cannot be exactly predicted, based on laws of mathematical probability, in a typical situation with five hundred players playing two thousand card faces, on average a winner results after approximately twenty-five to fifty "calls", and a single game of bingo has a duration of approximately ten to thirty minutes, depending on the pattern version.

While bingo is traditionally played in bingo halls, more recently various systems have been proposed for playing bingo over a large geographic area employing appropriate player terminal equipment and a communication network, preferably a network which supports interaction. Examples of such systems are disclosed in Timms U.S. Pat. No. 4,875,686, the above-referenced Pocock et al U.S. Pat. No. 5,297,802, and Fioretti U.S. Pat. No. 5,351,970.

Bingo, although highly popular, is subject to a number of limitations, particularly when the number of players is increased, such as when played over a large geographic area. Thus, although an extremely large number of unique game card faces may be produced (e.g. $3003^5$ as mentioned above) for distribution among the players, as the number of players and game cards in use increases, the length of a game before a winner results becomes very short, and the number of games with simultaneous winners as a given number is called ("repeat" winners) increases.

In bingo as ordinarily implemented and played there is little ability to readily control the average length of a game or the number of "repeat" winners. Only limited control is achieved through varying the size of the number set, for example by increasing the size of the number set from 1 through 75 to 1 through 90.

Ordinary bingo has a related shortcoming in the opposite situation, that is, where there are a relatively few number of players such as in a casino situation where a relatively small number of players are playing. An example would be an attempt to implement a bingo game in a casino environment with a relatively small number of players at individual video terminals tied to a communications network. If ordinary bingo were employed, with its inherent lack of control over the average duration of play or number of "repeat" winners, such a game could be relatively uninteresting as "calls" could be made without any player being able to "mark" a game face, and the games could become unduly long.

To add interest to ordinary bingo, different pattern versions are played during a gaming session. Nevertheless, it would be desirable to increase the number of "versions" available.

Advantages of ordinary bingo include that the game is relatively easy to play and enjoys wide acceptance and popularity. Bingo additionally requires a certain amount of skill and dexterity. Whatever the reasons, bingo has proved, over time, to be an enduring and popular game.

SUMMARY OF INVENTION

Accordingly, it is an object of the invention to provide improved bingo-like game systems which allow wide variations in the number of players, while allowing precise control over the probability of winning.

It is yet another object of the invention to provide bingo-like game systems with enhanced probability controls which are not readily apparent to the players.

It is yet another object of the invention to provide improved game systems which are superficially sufficiently similar to ordinary bingo so that the ease-of-play, level of skill and dexterity required, acceptability and popularity of bingo are all retained.

It is yet another object of the invention to provide improved bingo-like game system which support additional ways to win for further variety and which, additionally, allow cross-column calling and marking.

It is yet another object of the invention to provide improved bingo-like game systems which are amenable to implementations employing computer-based communication networks, both on a relatively local basis such as within an individual casino, as well as over a wide geographic area.

It is yet another object of the invention to provide improved bingo-like game systems which support a number of ways in which an individual player may either partially or entirely select or tailor an individual game card or game face, to arrive at a perceived "lucky" game face.

It is yet another object of the invention to provide improved bingo-like game systems which are adaptable to a lottery implementation wherein a number of game faces are distributed, with individual positions being covered with a "scratch-off" opaque material.

It is yet another object of the invention to provide improved bingo-like game systems wherein a number of sub-games may be played simultaneously, allowing a number of players, with different winning criteria, to win during a single game session.

Very briefly, and in accordance with an overall aspect of the invention, game systems are provided which employ combinations of multiple variables from different sets to increase the number of pattern permutations on individual game faces which are superficially similar to ordinary bingo game cards, preferably in combination with a system of random selectors, which together allow precise control over the mathematical probabilities of winning. By way of example, and not limitation, one set of multiple variables may contain colors, another set may contain symbols such as numbers or letters, and another set may include geometric shapes such as circles, diamonds and squares.

The game systems of the present invention facilitate the controllable reduction of the number of winning cards or game faces compared to regular bingo by generating a larger number of permutations than are available in ordinary bingo, and in a controlled manner.

Although the game systems of the present invention are superficially two-dimensional as in ordinary bingo, mathematically the games of the invention are based on a multi-dimensional "cubes" theory. As a rough approximation, a single column of a game face or card in accordance with the invention may correspond to an entire game card of ordinary bingo.

In accordance with a more particular aspect of the invention, game equipment is provided which includes a plurality of game faces, which may take the form of, for example, pre-printed game tickets, game tickets printed on demand on-site, images on a networked video display terminal, images on a networked electronic game board, or other suitable device or system for presenting a game face. Each game face has a plurality of individual positions organized as m rows by n columns, where m is an integer, and n is an integer greater than one. For convenience of description and illustration, the term "row" as employed herein refers to a horizontal row, and a "column" refers to a vertical column. However, it will be appreciated that these terms are somewhat arbitrary. For example, "rows" may be vertical, and "columns" horizontal. It will further be appreciated that various other geometrical arrangements may be employed with equivalent mathematical probabilities.

In one general form, m=n, resulting in 5×5 game faces as in ordinary bingo. Other suitable configurations, by way of example and not limitation, are m=n=3 for 3×3 game faces, and m=n=7 for 7×7 game faces. Further, for a single row game, m=1 and n=6, for example, a configuration which is particularly useful in lottery implementations.

Within each column of each game face, the individual positions are filled with a random sequence of elements from each of at least two sets of different entities. Preferably, one of the sets includes colors, such as five, six or seven different colors, and another one of the sets includes numbers or letters. Additional sets of different entities may be provided, such as geometric shapes.

In the preferred implementations, each column of the game faces has a unique column designation. Unlike ordinary bingo, elements from a given set, for example numbers, may repeat in different columns within the same game face. As a result, the column designations are meaningful during the course of play, and are not simply employed redundantly as a means of rapid identification of the particular column in which a called number is potentially to be found on an individual game face.

The invention also provides random selection apparatus which is particularly useful when employed in combination with the game faces as summarized above. The random selection apparatus generates a sequence of calls, where each call specifies an element from each of the at least two sets of different entities, for example a color and a number, such that a game player can designate individual positions on a particular game face which have elements that match the specified elements of a particular call. In addition, a call preferably includes a column designation.

The random selection apparatus includes a number of random selectors, related to each other in a particular manner as described hereinbelow. Depending upon the environment of the particular game being played, the random selectors may comprise airball machines as are commonly employed in bingo games and in televised lottery games, spinners, or electronic number generators in the case of highly computer-based implementations. The random selection apparatus includes at least one selector set and, in cases where there is a column random selector, includes one selector set for each column.

More particularly, in one embodiment the random selection apparatus includes a column random selector for randomly selecting a sequence of columns for providing column calls and additionally for designating the order of use of further selector sets.

The selector set, or each selector set in implementations where there is a selector set for each column, includes a first random selector for randomly selecting a sequence of elements from the first one of the sets, for example from the set of colors, without repeating any element until all elements of the first set have been selected. There is also a second random selector organized as individual selector bins corresponding respectively to the elements of the first set, in this example corresponding to colors. Each of the individual selector bins randomly selects a sequence of elements from a second one of the sets, for example from the set of numbers, as that individual selector bin is designated by the selection by the first random selector of a corresponding element from the first one of the sets, in this example, a color.

It will be appreciated that the term selector "bin" as used herein is employed in a general sense, appropriate to the particular random selector being employed. Thus, in the case of an airball machine, a "bin" may be viewed as an airball hopper, or other mechanical arrangement. In the case of a random selector in the form of a spinner, a "bin" may be viewed as a circular arrangement of elements, for example, colors, numbers or geometric shapes. In the case of a random selector in the form of an electronic random number generator, a "bin" may be in the form of individual locations within a computer memory, or equivalent computational structure.

In the event a third set of entities is employed, for example geometric shapes, the second random selector has further individual selector bins corresponding respectively to the elements of the first one of the sets, again in this example corresponding to color. Each of the further individual selector bins randomly selects a sequence of elements from the third one of the sets, in this example geometric shapes, as that further individual selector bin is designated, along with the likewise corresponding individual selector bin, in this example selecting numbers, by the selection of the first random selector of a corresponding element from the first one of the sets, in this example a color.

Although elements of the first set, in this example, colors, are reused during a game, preferably, each of the individual selector bins and each of the further individual selector bins randomly selects a sequence of elements from its corresponding set without repeating any element within a game. Thus, duplicate "calls" are avoided.

In accordance with yet another aspect of the invention, there is provided a system for generating game faces as summarized hereinabove. The system for generating game faces preferably is computer-based, and includes a memory storing elements of at least two sets of predefined entities, and a random position-filling device for, within each column of a game face, filling the individual positions with a random sequence of elements from each of the at least two sets of predefined entities. The random position-filling device ensures that, within each column of the game face, no element from any of the two sets is repeated.

The system for generating game faces, generates game faces in a variety of forms. Thus, in one embodiment, the system includes a printer for printing game faces in hard copy form. In another embodiment, the system includes a plurality of networked video displayed terminals or similar electronic game boards for presenting generated game faces.

In one form, the system is accessible by an individual game player for on-site generation of a game face.

In another form, the random position-device allows an individual game player to choose an element from each of the at least two sets for the first position in each column, and the system then fills in the remaining positions within each column, preferably, ensuring that within each column, no element from any of the sets is repeated.

In accordance with yet another aspect of the invention, a gaming system is provided which employs a plurality of game faces, each as summarized above, and a game face generator, likewise as summarized above. Such a gaming system may be computer based, and include a network so as to operate with a plurality of individual game terminals within a casino environment, or over a wide geographical area.

BRIEF DESCRIPTION OF THE DRAWINGS

While the novel features are set forth with particularity in the appended claims, the invention, both as to organization and content, will be better understood and appreciated on the following detailed description, taken in conjunction with the drawings, in which:

FIG. 9 indicates the manner in which

FIG. 10 indicates the manner in which

DETAILED DESCRIPTION

Game Faces

Figure 1:
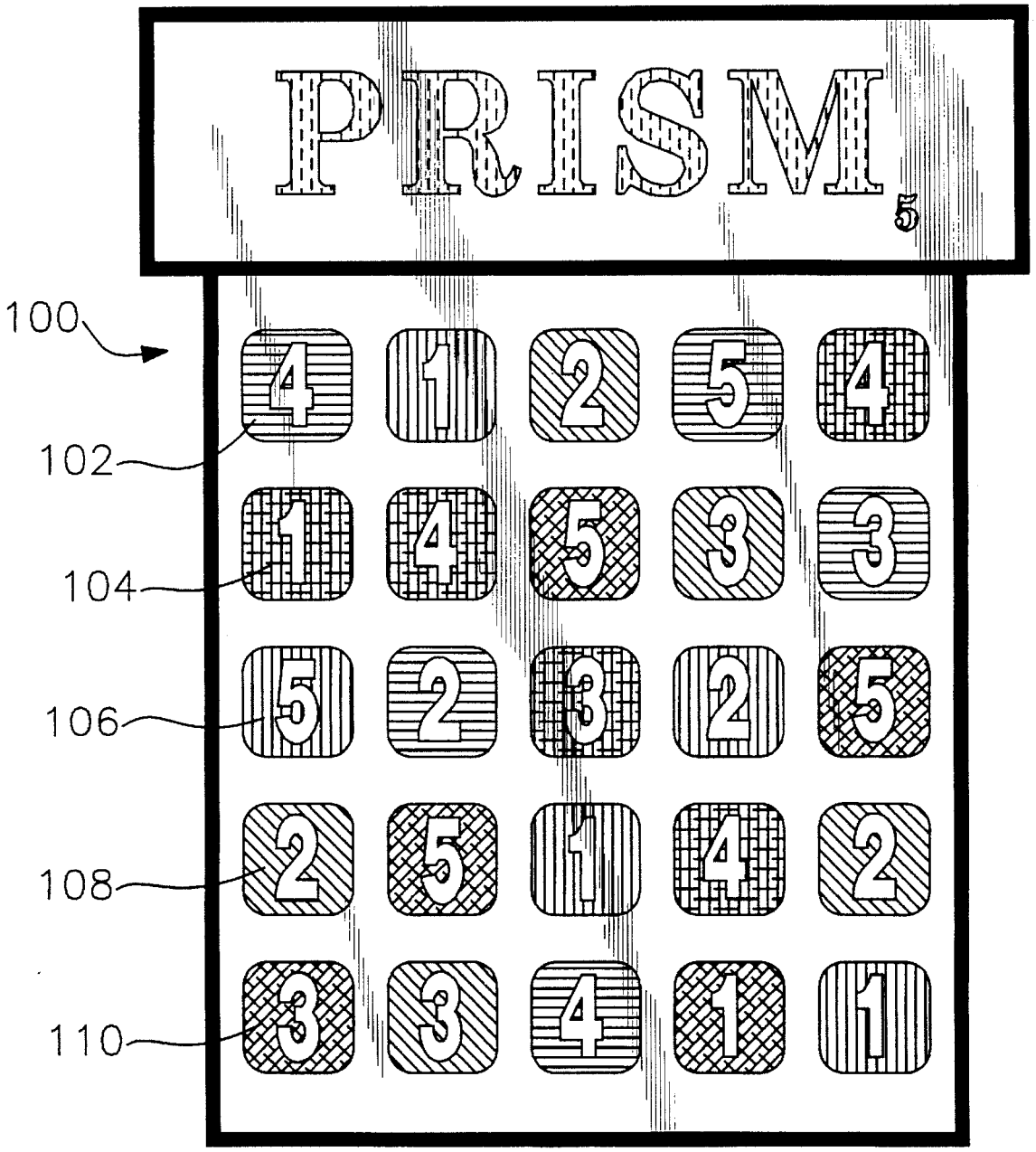
FIG. 1, wherein symbols are employed to indicate colors, depicts one embodiment of game face in accordance with the invention, termed for purposes of example a $PRISM_5$ game face.

Referring first to FIG. 1, an exemplary game face 100 has a plurality of individual positions organized as 5 rows by 5 columns, as in ordinary bingo, and is for playing a game for purposes of example designated PRISM$_5$. It will be appreciated that the game face 100 is one of a great many non-identical game faces distributed among a number of individual game players. The game face 100 of FIG. 1 is representative of a variety of specific implementations including pre-printed game tickets, game tickets printed on demand on-site, images on a networked video displayed terminal, and images on a networked electronic game board.

Each of the columns has a unique column designation; in FIG. 1 these are "P", "R", "T", "S", and "M". Within each column, the individual positions are filled with a random sequence of elements from each of two sets of different entities, more particularly, a set of colors (e.g. blue, green, yellow, orange and red) and a set of numbers, in this example, integers from 1 through 5. The total number of integers, that is 5, corresponds to the subscript in the name of this particular game, PRISM$_5$. As used herein, the term "filled" is not intended to indicate a quantity, such as "completely filled." Rather, the term "filled" is intended to indicate designation in any appropriate manner. An alternative term could be "contains."

Thus, considering the first column, designated "P", the first position 102 is filled with the color blue and the number "4"; the second position 104 is filled with the color yellow and the number "1"; the third position of 106 is filled with the color red and the number "5"; the fourth position 108 is filled with the color green and the number "2"; and the fifth position 110 is filled with color orange and the number "3".

In order to facilitate probability controls, preferably neither colors nor numbers repeat in the same column. Nevertheless, it is certainly possible and within the scope of the invention for colors, numbers, or both to repeat within the same column, but with decreased control over the probabilities of winning.

Although elements of a particular set of entities, for example, numbers, preferably do not repeat within a single column, colors and numbers do repeat over the game face as a whole. Thus, the column designations "P", "R", "T", "S" and "M" are meaningful.

Particular random selection apparatus for generating "calls" is described in detail hereinbelow with reference to FIGS. 9 and 10. However, at this point it very briefly may be noted that during the playing of a game, a "caller" employs random selection apparatus, for example airball hoppers, to randomly select and call a column, a color and a number to be marked or covered within the spaces or positions located on each player's card face. The players use appropriate markers to mark or designate called spaces that appear on their cards.

A winning pattern or other objective is determined and announced by the game organizer or "caller" prior to play, and each player attempts to be the first to satisfy the pattern or other objective. Examples are a vertical line, (there are five possible vertical lines); a horizontal line (there are five possible horizontal lines); a diagonal line (there are two possible diagonal lines); each of the four corner spaces or positions; and all of the spaces or positions designated with a single color.

When a player has achieved the objective, that player indicates the objective being reached, and optionally calls out the particular objective, for example, "color prism", and also states what color was marked, if the marking covered five colored spaces within the first 25 calls, for example. Another example is "pattern prism", with the player stating what pattern was formed when marked.

Depending upon the game organizer's or caller's determination, game play continues until there are winners for each of the designated games.

The game face 100 of FIG. 1 employs numbers from the number set 1 through 5, corresponding to the subscript in the game designation PRISM$_5$, and each of the numbers 1 through 5 appears in each of the columns.

Figure 2:
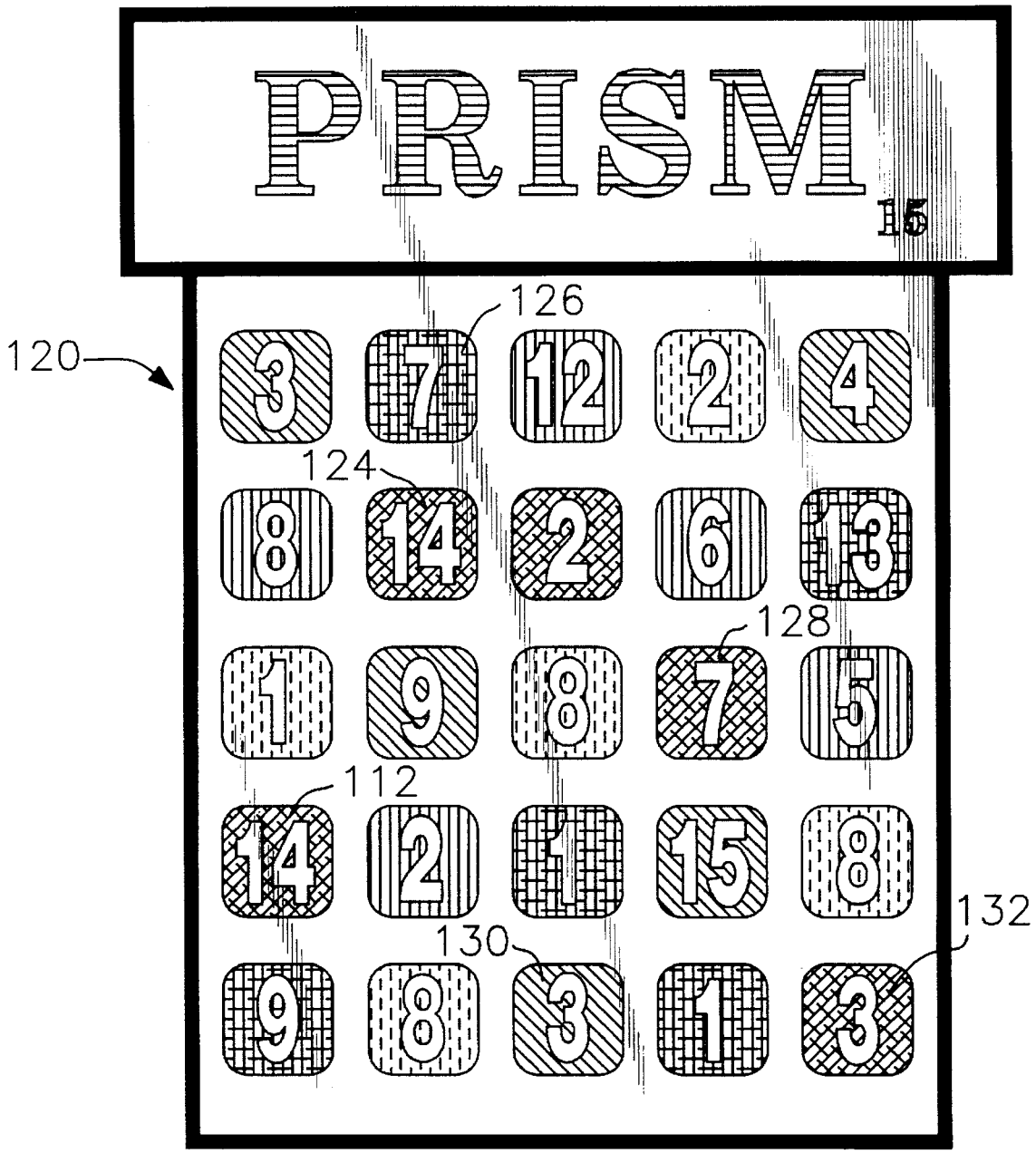
FIG. 2, wherein symbols are employed to indicate colors, represents another form of game face in accordance with the invention, termed for purposes of example a $PRISM_{15}$ game face.

FIG. 2 represents a very similar exemplary game face 120, where the number set is from 1 through 15, corresponding to the subscript in the game designation PRISM$_{15}$. The five colors employed are unchanged (but are randomly arranged differently within the various columns of the FIG. 2 exemplary card 120).

The increase in the number set from 1 through 5 to from 1 through 15 represents one form of probability control for increasing the number of possible players without increasing the number of "repeat winners", or decreasing the probability of a given player winning. (Nevertheless, each game face has a probability of winning equal to all of the other game faces.) Arbitrary number sets can be employed, but it is preferable to employ number sets that are multiples of 5 in the case of 5×5 game faces.

As will be apparent from FIG. 2, each of the five colors from the set of colors appears once in each of the five-position columns, but all of the numbers necessarily do not appear since there are more available numbers than there are positions within a column. Neither colors nor numbers repeat within a single column, but numbers can repeat on the game face as a whole. Thus, positions 122 and 124 each contain the number "14"; positions 126 and 128 each contain the number "7" and positions 130 and 132 each contain the number "3".

Another difference compared to regular bingo, although not specifically illustrated in FIG. 2, is that the addition of a second random variable, in particular color, makes it less important to eliminate as unacceptable game faces which have sequential numbers in a given column, for example "1-2-3-4-5" in a single column (not shown).

Comparing the game face 120 of FIG. 2 with a game card employed in ordinary bingo, there is a common factor in that the numbers in the first column are selected from the set of integers from 1 through 15. Despite superficial similarity, beyond that there are significant differences. For example, the same set of numbers is available for random placement in each of the subsequent columns; accordingly, the column designations "P-R-I-S-M" are significant. In addition, there is a second random variable, namely color.

Compared to ordinary bingo, there are more ways to win with the game systems of the invention. For example, a player can win by being the first to mark five "red" numbers without regard to any pattern formation. As a "caller's option" there may be a different pay-out for each color group.

Another variation involves cross-column calling where column designations are not employed, resulting in "flash"

games. Thus, players can cover called spaces (which match both the color and number called), without regard to column designations.

Figure 3:
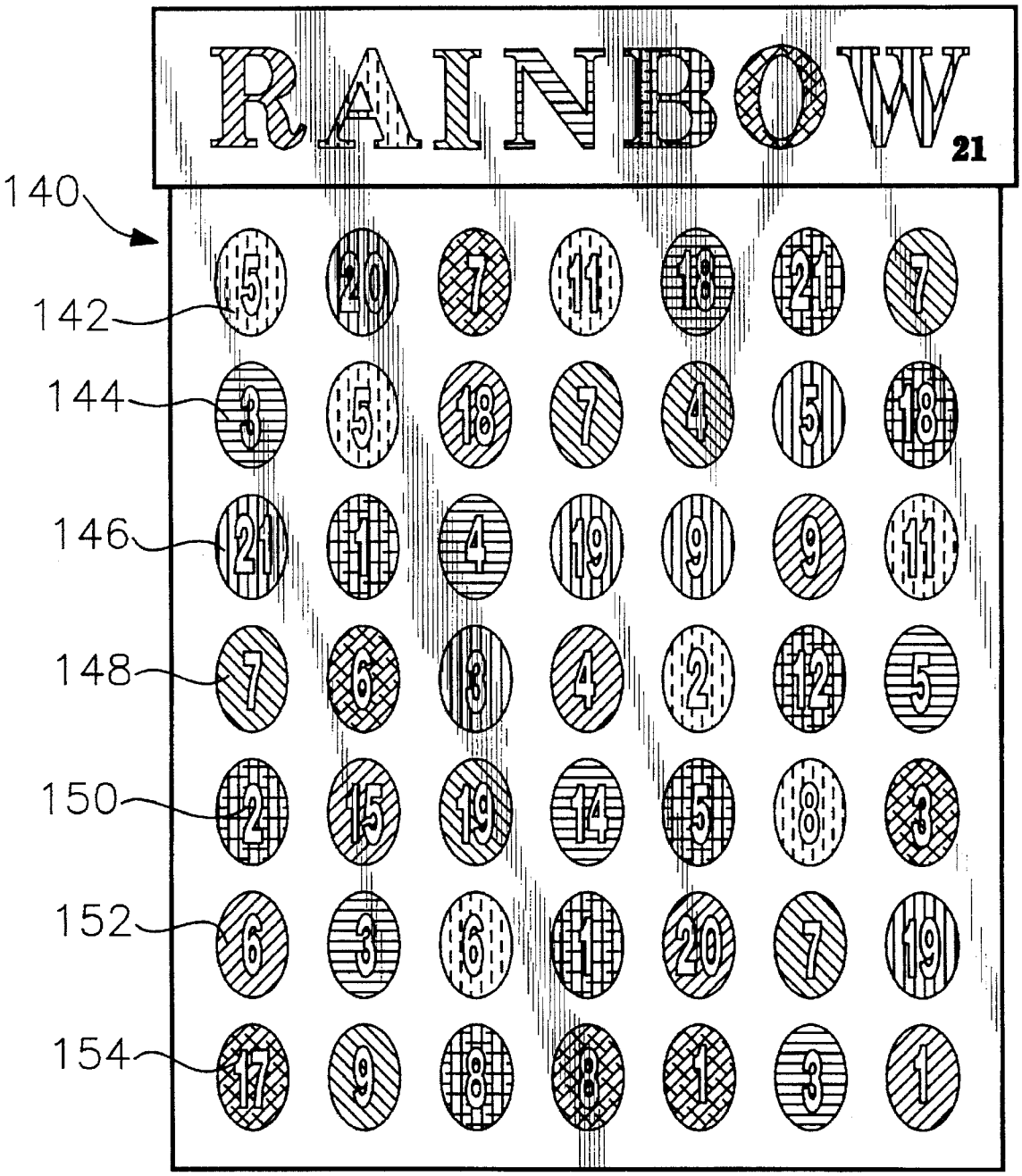
FIG. 3, wherein symbols are employed to indicate colors, depicts yet another form of game face in accordance with the invention, termed for purposes of example a $RAINBOW_{21}$ game face.

Referring now to FIG. 3, depicted is yet another game face 140, having a plurality of individual positions organized as 7 rows by 7 columns. Also a set of seven different colors is employed. Thus, in the first column, position 142 is filled with "violet" and "5" position 144 is filled with "blue" and "3", position 146 is filled with "red" and "21", position 148 is filled with "green" and "7", position 150 is filled with "yellow" and "2", position 152 is filled with "brown" and "6", and position 154 is filled with "orange" and "17". This particular game is designated $RAINBOW_{21}$, a name with 7 different letters which conveniently are employed to designate the 7 columns, with the subscript "21" indicating that a number set from 1 through 21 is employed.

In other respects, the game of $RAINBOW_{21}$ represented by the card face 140 of FIG. 3 is similar to the game $PRISM_{15}$, represented by the card face 120 of FIG. 2, with of course different probabilities of winning.

Figure 4:
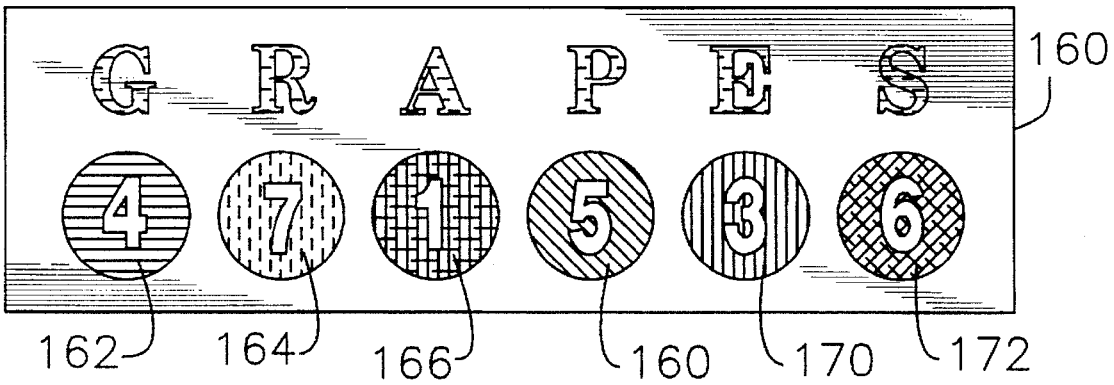
FIG. 4, wherein symbols are employed to indicate colors, depicts yet another game face in accordance with the invention, a single-row game face termed, for purposes of example, a GRAPES game face.

Referring now to FIG. 4, represented is another game face 160, having just a single row, and 6 columns, illustrating that game faces in accordance with the invention are not limited to having the same number of columns and rows. The game face 160 of FIG. 4, for purposes of example, is indicated as being for a GRAPES game, the 6 letters of which serve also as column designators, and is particularly useful in a "Lotto" implementation.

In the particular game face 160 of FIG. 4, the "G" column position 162 is filled with "blue" and "4", the "R" column position 164 is filled with "violet" and "7", the "A" column position 166 is filled with "yellow" and "1", the "P" column position 168 is filled with "green" and "5", the "E" column position 170 is filled with "red" and "3" and the "S" column position 172 is filled with "orange" and "6".

As one alternative, a game player may purchase a preprinted "GRAPES" card. As another alternative, a player may select the colors and numbers desired employing appropriate computer-based terminal equipment.

During the playing of a game, three-part calls comprising a column designation, a color and a number may be generated in any appropriate manner, such as dice, cards, or air-ball hoppers. Various ways of winning may be specified, with differing pay outs. For example, a winning card may be one in which a single space is covered, matching a called column, color and number. As another possibility, deserving a higher pay out, all of the positions on a card may be covered, in any order. As yet another example, deserving an even higher pay out, the six positions on the game face may be covered in consecutive order as calling proceeds.

The game faces 100, 120, 140 and 160 described hereinabove with reference to FIGS. 1–4 each employ two sets of different entities, namely, colors and numbers.

Figure 5:
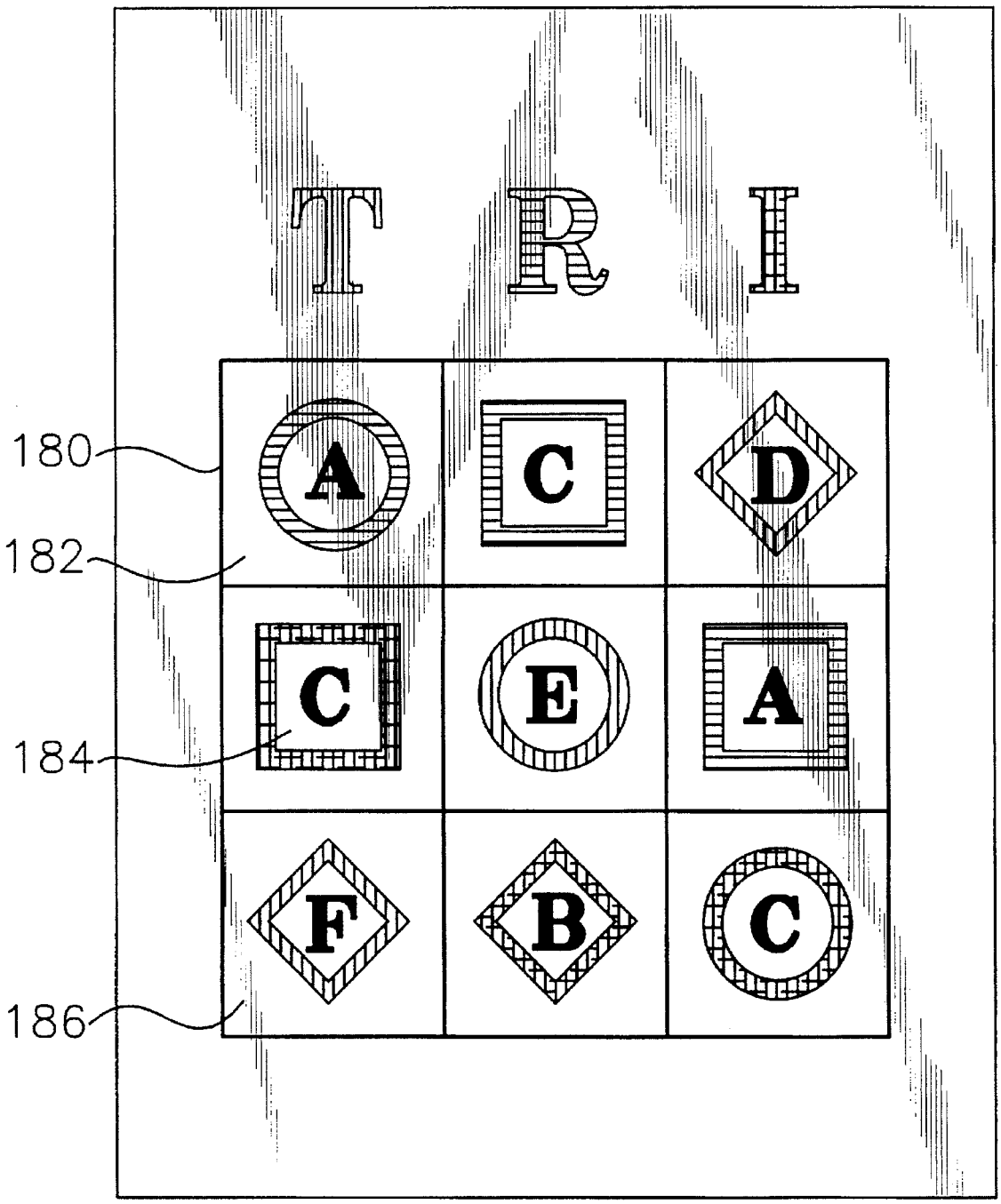
FIG. 5, wherein symbols are employed to indicate colors, depicts yet another game face in accordance with the invention, termed for purposes of example a TRI game face.

With reference now to FIG. 5, represented is a game face 180, for playing a game herein termed "TRI" which adds another set of different entities or random variables, geometric shapes in this particular embodiment. To further illustrate the various ways in which the invention may be implemented, rather than numbers, the game face 180 employs a set of 6 letters from "A" through "F". FIG. 5 also indicates that the "filling" with colors may be accomplished other than by employing a solid background color. Thus, in FIG. 5 it is the shape employed which is colored. Alternatively, the letters may be colored.

More particularly, the "TRI" game face 180 is organized as 3 rows by 3 columns. Although this is apparently a much smaller game face than an ordinary 5×5 bingo game face, far more players can be accommodated without unduly fast games or excessive "repeat" winners due to the multiple random variables employed, namely colors, letters and shapes. In the "T" column, for example, the first position 182 is filled with the color "blue", the symbol "A", and the shape "circle." The second position 184 is filled with the color "yellow", the symbol "C", and the shape "square." The third position 186 is filled with the color "red", the symbol "F", and the shape "diamond." The "R" and "I" column positions are similarly filled with colors, symbols and shapes as indicated in the example.

A game employing the "TRI" game face 180 of FIG. 5 is played in a similar manner to the game described hereinabove with reference to FIG. 1, except that another element is added to each "call". Thus, during the playing of "TRI", each call includes an optional column designation (i.e. "T", "R" or "I"), a color designation, a letter designation, and a shape designation.

It will be appreciated that the foregoing names of games are arbitrary insofar as the invention is concerned, and a variety of names may be employed to imply different game variations, while maintaining substantially the same effect. Thus, for games with five columns, in addition to PRISM, exemplary names of games are PRIZE, FLASH and TRUMP. For a game with six columns, the name CASINO may be employed, as an alternative to GRAPES. For a game with seven columns, in addition to RAINBOW, the name DIAMOND may be employed. For 3×3 games, as alternatives to TRI, the names ACE, and YES may be employed.

Version Controls

It will further be appreciated, based on the foregoing, that a variety of version controls may be employed to control the probabilities of winning, particularly when the game faces are employed in combination with random selection apparatus as is described hereinbelow with reference to FIGS. 9 and 10. By way of brief summary, as one control the overall size of the game face may be varied. Examples are 5×5, 7×7, 3×3, 1×6, and 1×10.

As a further control, the number of elements in a set may be varied. For example, for a 7×7 game face, the number set may range from 1 through 7, from 1 through 14, or from 1 through 21, preferably but not necessarily in multiples of 7. For a 5×5 game face, the number set may range from 1 through 5, from 1 through 10, from 1 through 15, from 1 through 20 or from 1 through 25, preferably but not necessarily in multiples of 5. In addition to varying the number set, the color set similarly may be varied. For example, on a 5×5 game face, 5, 6 or 7 different colors may be employed. Increasing the number of colors beyond 7 becomes somewhat difficult, simply because it is more difficult to distinguish different colors.

As a still further control, the number of sets employed may be varied. For example, two sets such as colors and symbols; or three sets such as colors, symbols, and geometric shapes.

In addition, the invention provides various individual approaches by which players can either partially or entirely select a "lucky" game face as is described hereinbelow in greater detail, for example with reference to FIG. 8.

In one variation for use with a 5×5 game face, only five numbers are used in combination with six colors. For some players this variation is as easy to play as ordinary bingo, although the games last longer and more people can play. The number of ways to win can be increased, for example five of the same color within a given number of calls. Thus, players can play fewer cards simultaneously, and still have more ways to win compared to ordinary bingo.

In ordinary bingo the "free space" has a fixed centered position in the "N" column. In implementations of the invention, the free space is optional. If used, it may appear anywhere on the card face, and may appear numerous times.

In ordinary bingo there are no "official" wild balls. In some versions of the invention, wild column calls may be included, as well as wild color calls. For example, after a wild column call, whatever color is subsequently called is considered to be wild and may be marked no matter where it appears on the card face. After a wild color call, whatever number is subsequently called may be marked regardless of the position color within the selected column. There are no wild number calls.

Compared to ordinary bingo, a 7×7 game face of the invention provides more patterns which may be formed. A version may be added to the 7×7 version to be played as a miniature fill-up.

Game Face Generation

Figure 6:
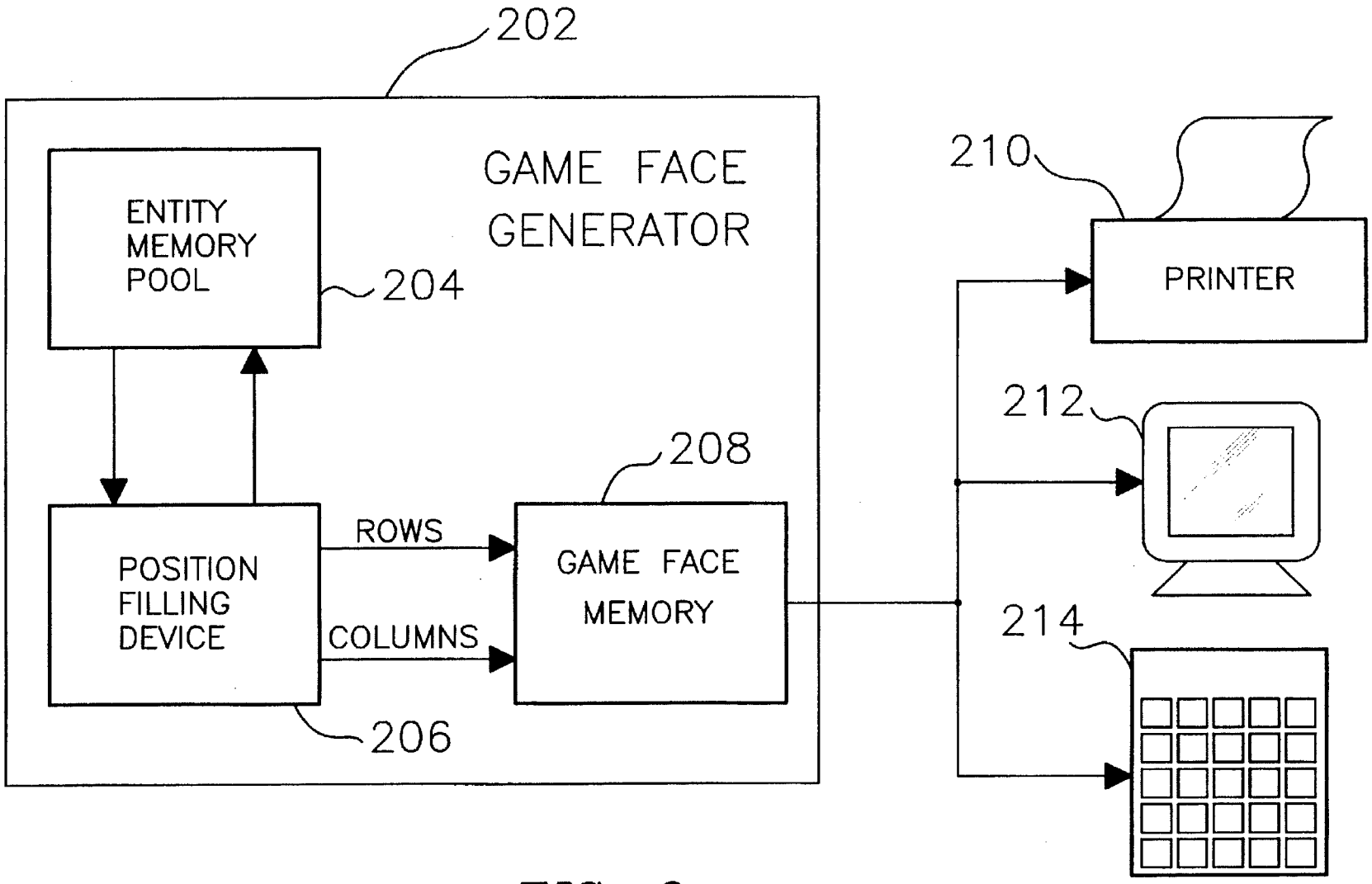
FIG. 6 schematically depicts a system for generating game faces.

Referring now to FIG. 6, shown in block diagram form is a system, generally designated 200, for generating game faces, such as the game faces described hereinabove with reference to FIGS. 1–5. The system 200 includes a game face generator 202, which may comprise an appropriately-programmed computer system, including a memory storing elements of at least two sets of predefined entities (e.g. colors, symbols such as numbers or letters, and geometric shapes), represented in FIG. 6 as an entity memory pool 204. It will be appreciated that the entity memory pool 204 is a highly generalized representation of a wide variety of programming techniques that may be employed for "storing" elements of the entity sets. For example, in one form the entity memory pool 204 comprises simple tables of the available entities in each of the sets, and selections are appropriately made from these tables as game faces are generated. Alternatively, the entities may be represented in some other manner in the entity memory pool 204; thus, rather than a table of available numbers, a random number generator may be employed.

The game face generator 202 additionally includes a random position filling device 206 logically connected to a game face memory 208 in which a game face under construction is maintained. The position filling device 206 operates to, within each column of a game face, fill the individual positions with a random sequence of elements from each of the at least two sets of predefined entities, for example, a random sequence of colors and a random sequence of numbers. Preferably, the random position filling device 206 ensures that within each column of the game face, no element from any of the sets is repeated.

Output of the system 200 can occur in a variety of forms, for example, in hard copy form on a printer 210, on a video display terminal 212, or on a dedicated electronic game board 214. The printer 210 may be employed to either generate a batch of game faces for later distribution, or may be located on-site to print customized game cards for individual players immediately prior to the playing of a game or a series of games.

Figure 7:
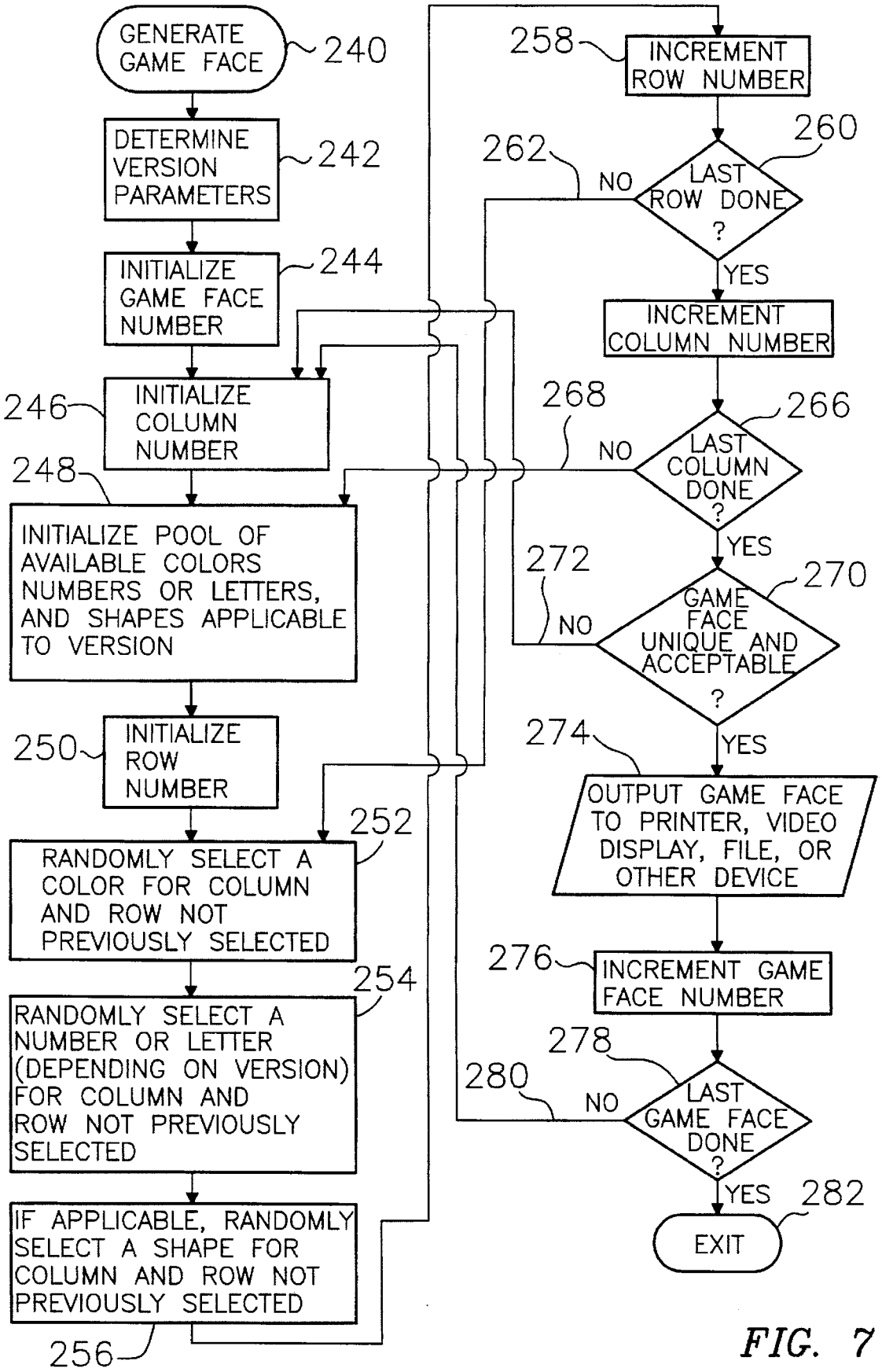
FIG. 7 is an exemplary program flow chart representing the operation of one form of game face generator in accordance with the invention.

With reference now to FIG. 7, operation of the FIG. 6 game face generator 202 is represented in greater detail by means of a program flow chart representing a "generate game face" routine 240. It will be appreciated that the programming represented by the flow chart of FIG. 7 is implemented within the game face generator 202 of FIG. 6 which, as noted above, preferably comprises an appropriately-programmed computer system.

As an initial step, in box 242 version parameters are optionally determined, such as by player input. Version parameters include the size of the game face, the number of colors employed, the number of numbers employed, and whether two or three random variables are employed. Version parameters also may be viewed as probability controls.

Particularly for generating a batch of game faces, in box 244, the game face number is initialized, for example to "1". In box 246, which is inside a loop, the column number is initialized, for example to "1".

Next, in box 248, the FIG. 6 entity memory pool 204 is initialized, depending upon the particular version, with the available colors, numbers or letters and shapes applicable to the particular game version. In box 250, the row number is initialized, for example to "1".

In box 252, employing suitable random number generation techniques, a color for the current column and row position is selected from the pool, the color being one not previously selected for that particular column number. In box 254 a number or letter (depending upon the version) for the current column and row position is randomly selected from the available pool, again a number or letter not previously selected for that particular column.

Similarly, if applicable for the particular version, in box 256, a shape is randomly selected from the available pool for the current column and row position, likewise a shape not previously selected for that column.

In box 258 the row number is incremented, and decision box 260 tests whether the last row for the particular column has been done. If the answer in decision box 260 is "no", then execution branches along line 262 back to box 252, where another color is selected for the current column and row position, again a color not previously selected for that particular column. Execution similarly proceeds through boxes 254, 256, and 258 until the last row in the column is done, and the answer in decision box 260 is "yes".

In box 264 the column number is incremented and, in decision box 266, a test is performed to determine whether the last column is done. If the answer in decision box 266 is "no", then execution branches along path 268 back to box 248 where the pool of available colors, numbers or letters and shapes is again initialized. Filling of each successive column proceeds as described above until the answer in decision box 266 is "yes", whereupon decision box 270 is entered wherein it is determined whether the game face generated is unique (by comparison with previously-stored game faces), and otherwise acceptable. If the answer in decision box 270 is "no", then execution branches along path 272 to box 246, below box 244 where the game face number is initialized, and another attempt is made to generate that particular numbered game face.

If the answer in decision box 270 is "yes", then execution proceeds to box 274 where the game face is outputted to the FIG. 6 printer 210, video display 212, a file, (not shown) or other device. The game face number is then incremented in box 276 and in decision box 278 a test is performed to determine whether the last game face is done. If the answer is "no", then execution branches along path 280 back to box 246, to generate the next game face.

When the decision in decision box 278 is "yes", the FIG. 7 routine exits at 282.

Figure 8:
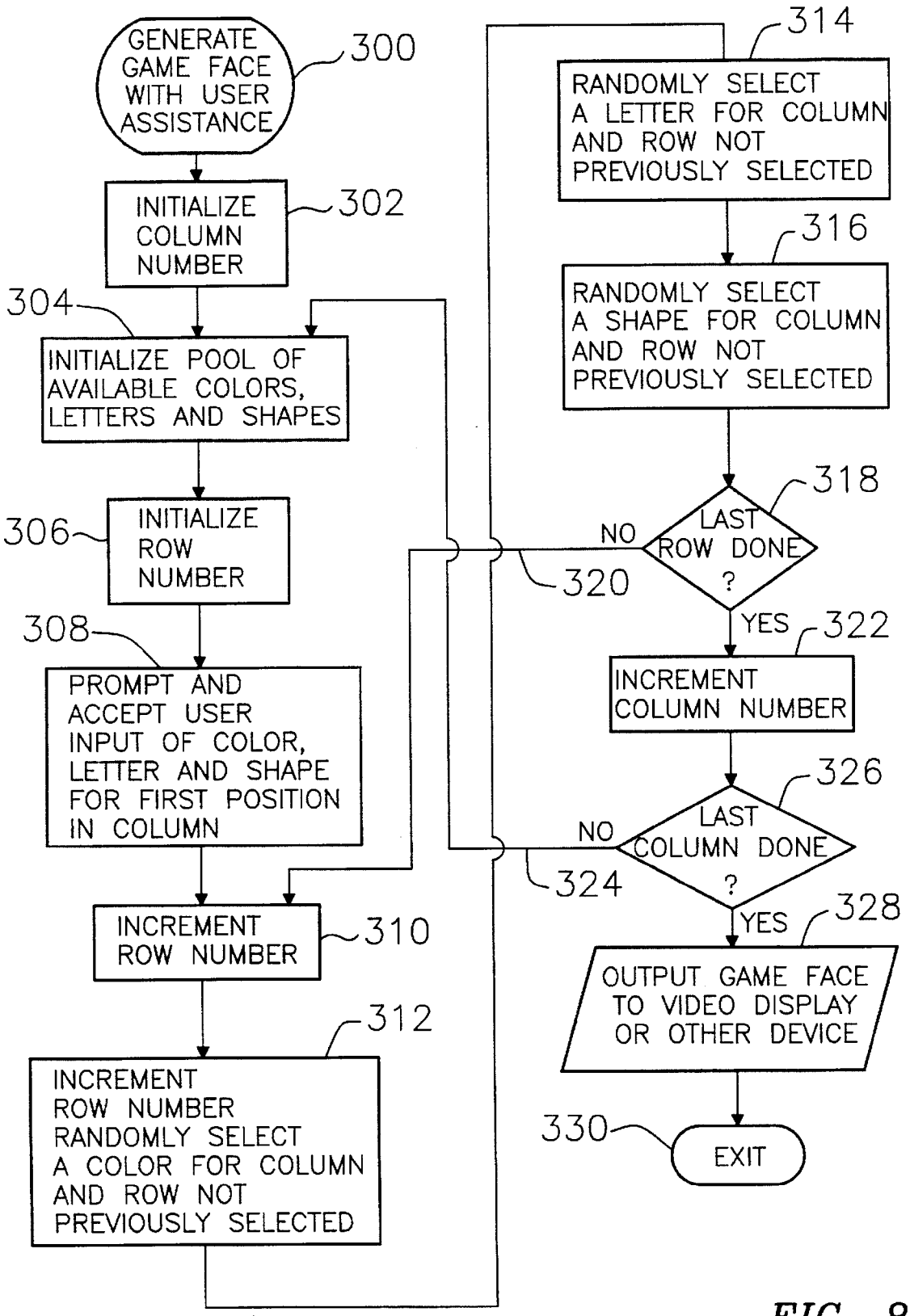
FIG. 8 is another exemplary program flow chart representing the operation of a game face generator which allows a game player to assist in the generation of a game face.

FIG. 8 is a flow chart for an alternative game face generating program routine 300 which enables an individual game player to select the elements in the first row of a game face, typically employing an interactive video terminal connected to the FIG. 6 game face generator 202, which is appropriately programmed in accordance with the flow chart of FIG. 8. The FIG. 8 flow chart, for purposes of example, may be viewed as applying to a "TRI" game, a game face for which is represented in FIG. 5, described hereinabove.

The first execution step depicted in FIG. 8 is in box 302, where the column number is initialized, for example to "1". Then, in box 304, the pool of available colors, letters and shapes is initialized.

In box 306 the row number is initialized and then, in box number 308, the game player is prompted to select the color, letter and shape for the first position in the column. Then, in a program loop involving boxes 312, 314, 316 and decision box 318, the remaining positions of the column are randomly filled with non-repeating colors, letters and shapes, and program branch 320.

When the last row position is filled, and the answer in decision box 318 is "yes", the column number is then incremented in box 322, and program execution branches along path 324 to accept game player input for the first position of each of the remaining columns until, in decision box 326, it is determined that the last column is done, and program execution proceeds through box 328 where the game face is output, for example to the FIG. 6 terminal 212, and the routine exits at 330.

Random Selection Apparatus

Although games in accordance with the invention, for example, PRISM, are designed to enhance and resemble ordinary bingo, the random selection of "calls" differs significantly. In combination with the game faces described hereinabove with reference to FIGS. 1–6, the manner in which "calls" are generated facilitates the probability controls and extended play benefits provided by the invention. As noted above, in the game systems of the invention, each column has independent variables with modifiable controls and flexible variable limits that can be set to modify the number of possibilities.

Preferably, color is one of the random variables employed. Color selection is decided independently of the other random variable or variables, although in an interdependent manner which will be apparent from the description hereinbelow with reference to FIGS. 9 and 10. As a matter of convenience in description, FIGS. 9A, 9B and 9C are collectively referred to hereinbelow as "FIG. 9", and FIGS. 10A and 10B are collectively referred to hereinbelow as "FIG. 10".

The random selection apparatus employs a number of random selectors which, in typical embodiments, are ordinary airball machines. Other forms of random selectors are spinners, and electronic random number generators. In games for home play, there are a variety of other possibilities such as dice sets, card sets, card holders, modified airball/cube machines, auto selectors, various forms of spinners, and even pre-recorded caller tapes. However, as a matter of convenience of description, the various random selectors of FIG. 9 are simply described herein as being conventional airball machines, appropriately labeled, and employing airballs appropriately designated with colors, numbers, letters and other appropriate indicia.

Figure 9:
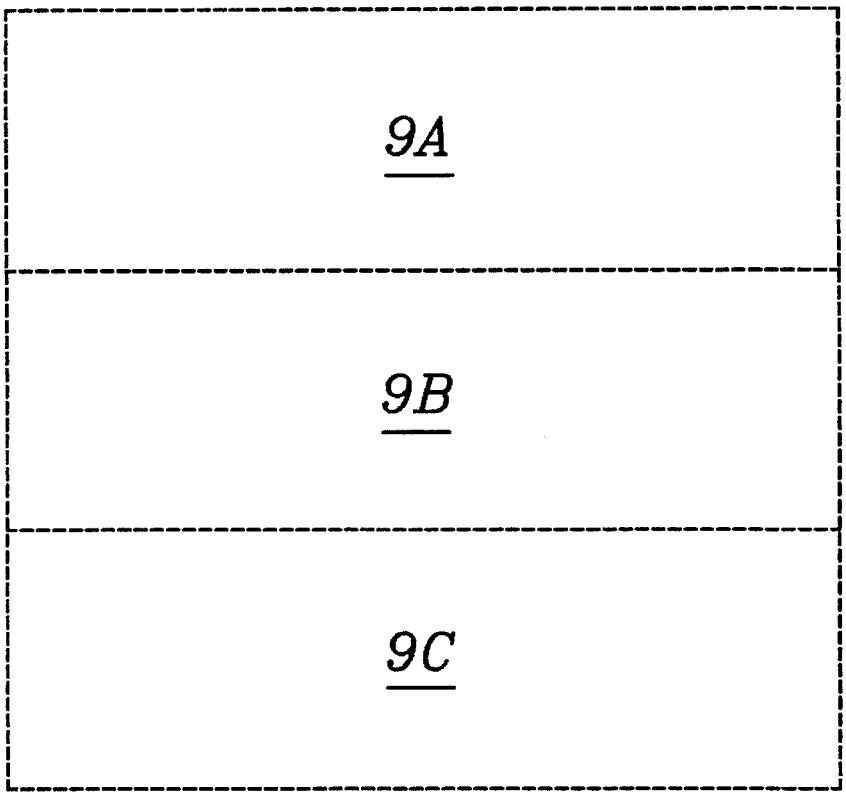
Figure 9A:
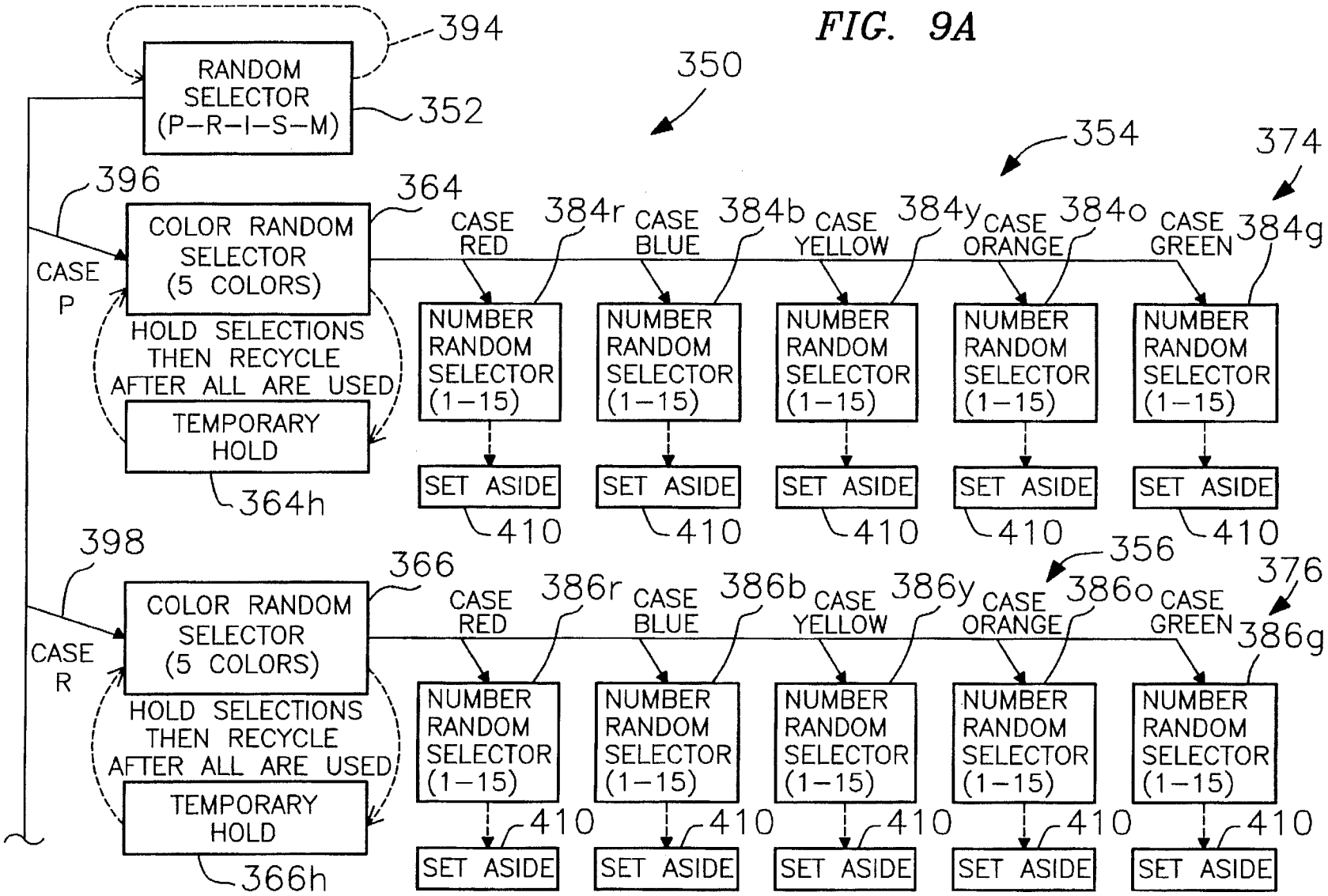
FIGS. 9A, 9B and 9C are juxtaposed to schematically depict random selector apparatus for use where two sets of entities are employed as random variables.
Figure 9B:
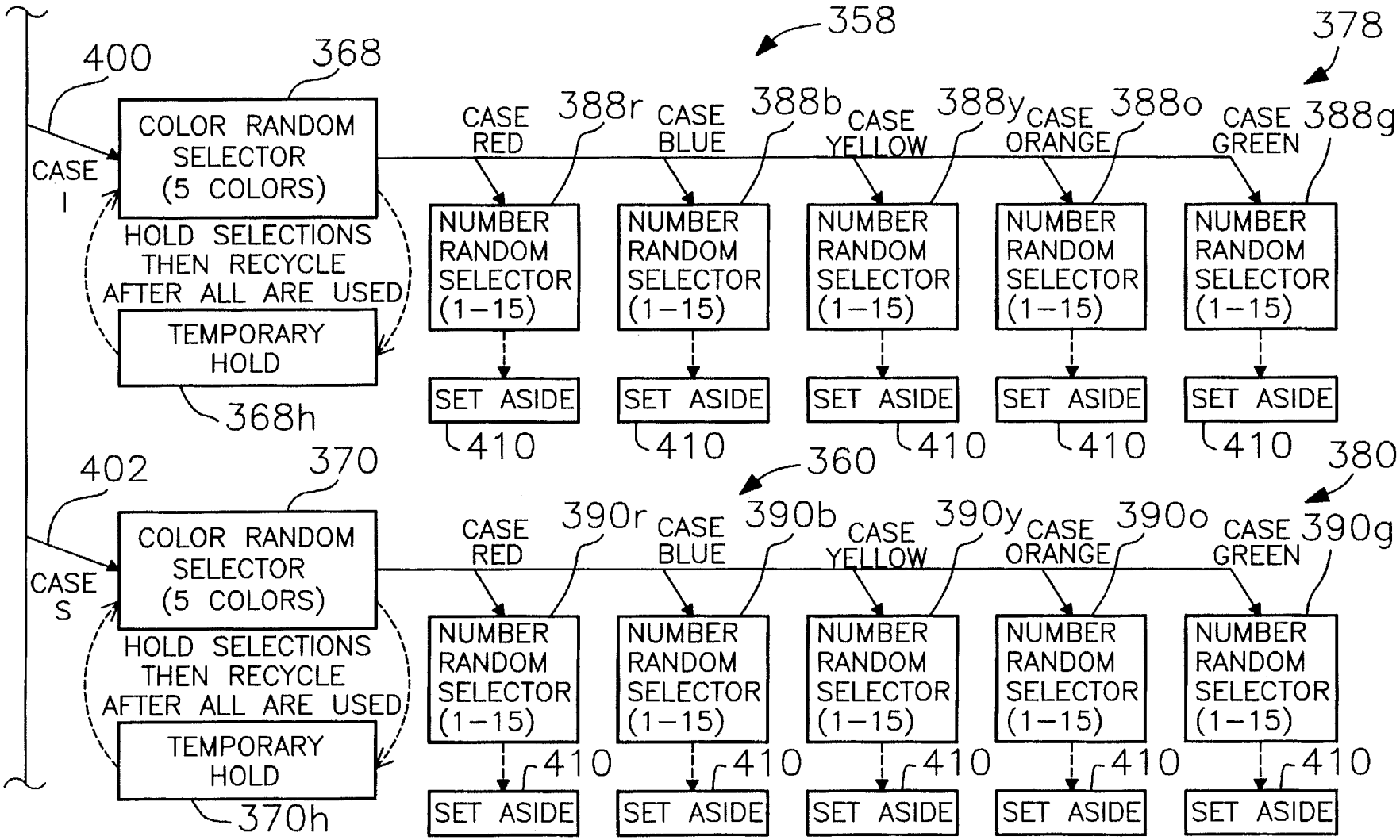
Figure 9C:
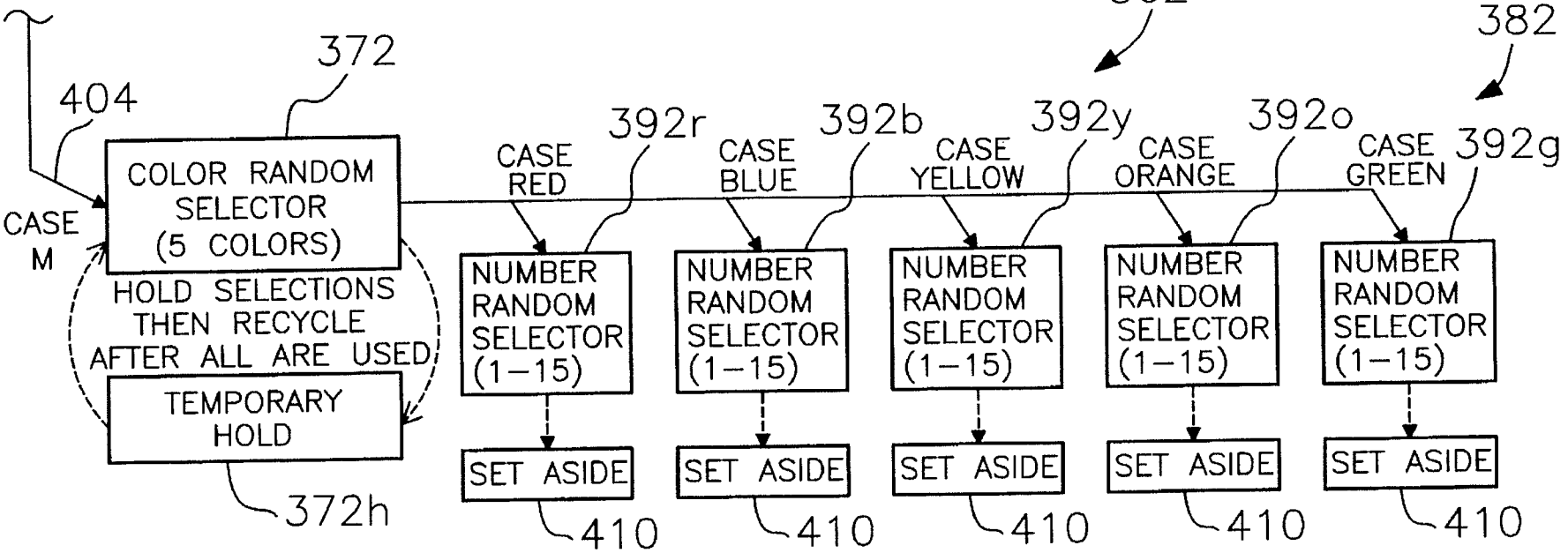

With particular reference now to FIG. 9, shown schematically is one embodiment of random selection apparatus 350, usable in combination with the $PRISM_5$ game faces such as the game face 120 of FIG. 2. In overview, the random selection apparatus 350 includes a column random selector 352 for randomly selecting a sequence of columns (from the columns designated P-R-I-S-M), and five random selector sets, one for each column, respectively generally designated 354, 356, 358, 360 and 362.

Each of the selector sets 354, 356, 358 and 360 in turn includes a corresponding first random selector 364, 366, 368, 370 or 372 (each termed a "Color Random Selector (5 Colors)"), and a corresponding second random selector 374, 376, 378, 380 or 382, in turn organized as individual selector bins corresponding to the colors. Respectively associated with the first random selectors 364, 366, 368, 370 and 372 are corresponding temporary hold devices 364*h*, 366*h*, 368*h*, 370*h*, and 372*h*. Thus the random selector set 374 corresponding to the "P" column includes five individual selector bins 384*r* (for red), 384*b* (for blue), 384*y* (for yellow), 384*o* (for orange) and 384*g* (for green), each randomly selecting numbers from the set of numbers 1 through 15. It will appreciated that each of these individual selector "bins" is itself a random selector, such as an airball machine, or other form of random selector, and is for example designated as a "Number Random Selector (1–15)."

Similarly, the random selector set 376, corresponding to the "R" column includes five individual selector bins 386*r*, 386*b*, 386*y*, 386*o* and 386*g*, each randomly selecting numbers from the set of numbers 1 through 15; the random selector set 378 corresponding to the "I" column includes selector bins 388*r*, 388*b*, 388*y*, 388*o* and 388*g*, each randomly selecting numbers from the set of numbers 1 through 15; the random selector set 380 corresponding to the "S" column includes random selector bins 390*r*, 390*b*, 390*y*, 390*o* and 390*g*, each randomly selecting numbers from the set of numbers 1 through 15; and the random selector set 382 corresponding to the "M" column includes bins 392*r*, 392*b*, 392*y*, 392*o* and 392*g*, each randomly selecting numbers from the set of numbers 1 through 15.

Considering the random selection apparatus 350 of FIG. 9 in greater detail, and in particular its operation, the column random selector 352 is an airball machine operating with at least five balls respectively designated "P", "R", "I", "S" and "M", corresponding to the five columns of the FIG. 2 game face. In addition, one or more "wild" column balls may be included for generating "wild" column calls. During game play, as indicated by the dash line 394, balls from the column random selector 352 are recycled so that the order of column selection is always random. Thus, it is entirely possible for the "P" column, for example, to be called twice in succession.

The ball drawn from the column random selector 352 determines which of the selector sets 374, 376, 378, 380 and 382 (corresponding respectively to the columns "P", "R", "I", "S" and "M") is designated. These designations are represented in FIG. 9 by individual "case" lines 396, 398, 400, 402 and 404. These "case" lines typically represent actions taken by the game caller, but could also represent program branches in the event the random selection apparatus 350 is implemented in a programmed computer.

By way of specific example, a ball designated "R" randomly drawn from the column random selector 352, designating the second column, corresponds to the second random selector set 356. Within the selector set 356, the color random selector 366 includes balls designating the five colors employed. In addition, one or more "wild" color balls may be included for generating "wild" color calls. The temporary hold device 366*h* associated with the color random selector 366 may have the physical form of a shelf or other display area for temporarily holding balls. As indicated by dash lines 406 and 408, selections from the color random selector 366 are temporarily held, and recycled only after all are used. Thus, within a calling sequence for a given column (disregarding calls for other columns which may be occurring in the meantime), no colors are repeated until all colors have been selected.

In any event, and continuing the example of the operation of the random selector set 356 corresponding to the "R" column, based on the color selected by the color random selector 366, the appropriate one of the individual selector bins 386*r*, 386*b*, 386*y*, 386*o* or 386*g* of the second random selector 376 is designated, again as represented by "case" lines, and then operates to randomly select a sequence of elements from the set of numbers as that individual selector bin is designated. Again, these "case" lines typically represent actions taken by the game caller, but could also represent program branches in a computer implementation.

During a game, elements selected from each of the random selector bins 386*r*, 386*b*, 386*y*, 386*o* and 386*g* are not reused, and the balls accordingly are set aside as indicated after being called. Thus, there are a number of individual "Set Aside" boxes 410. Otherwise, duplicate calls would result.

Figure 10:
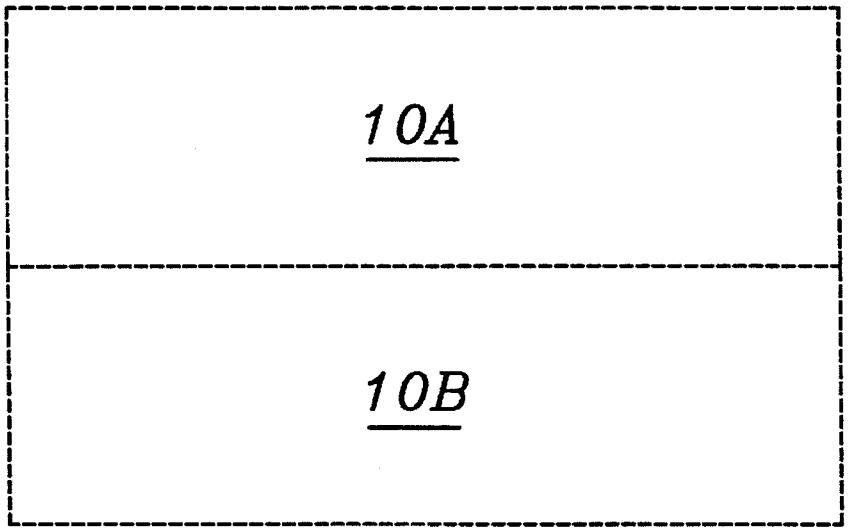
Figure 10A:
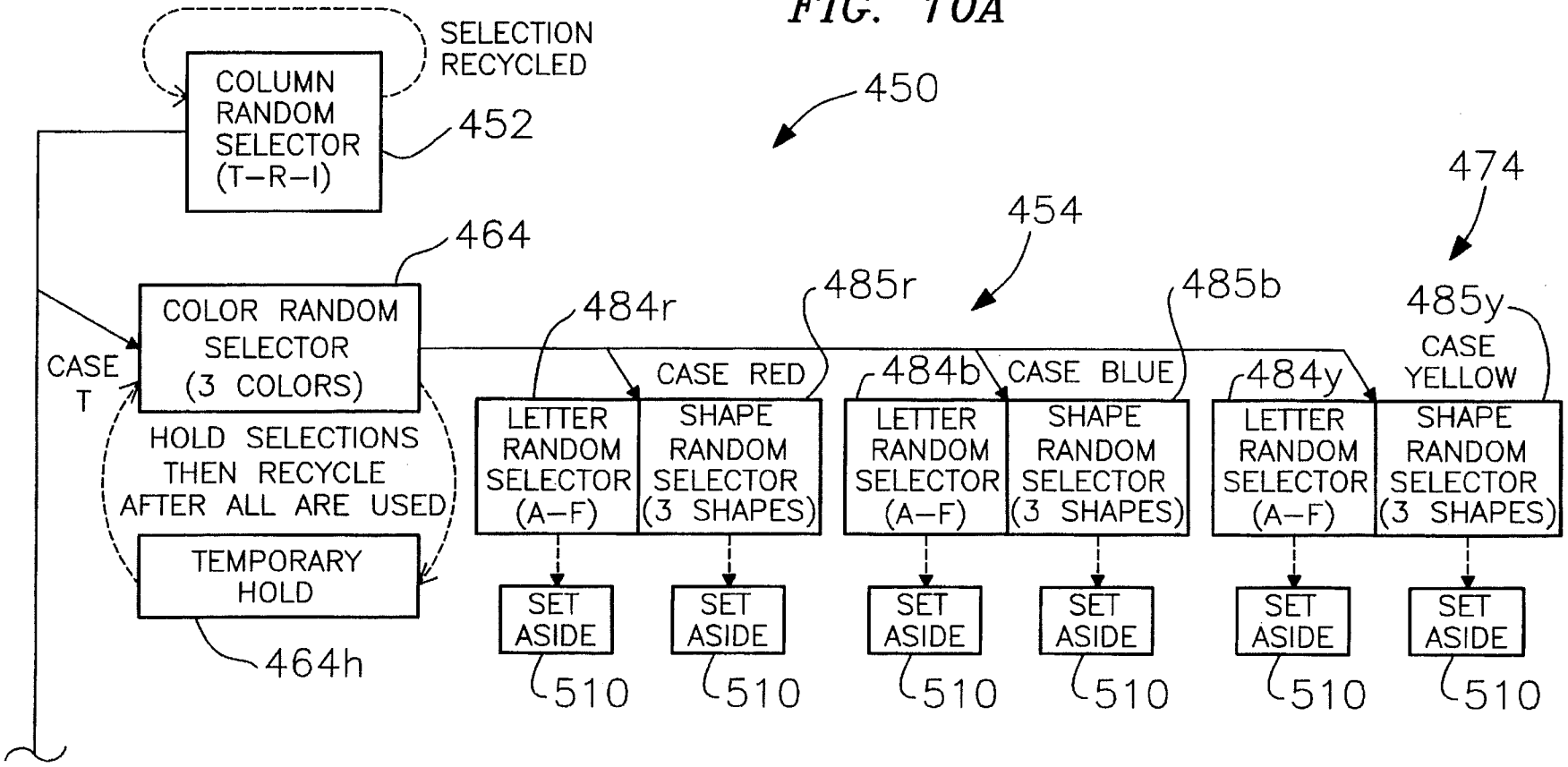
FIGS. 10A and 10B are juxtaposed to schematically depict random selector apparatus for use where three sets of entities are employed as random variables.
Figure 10B:
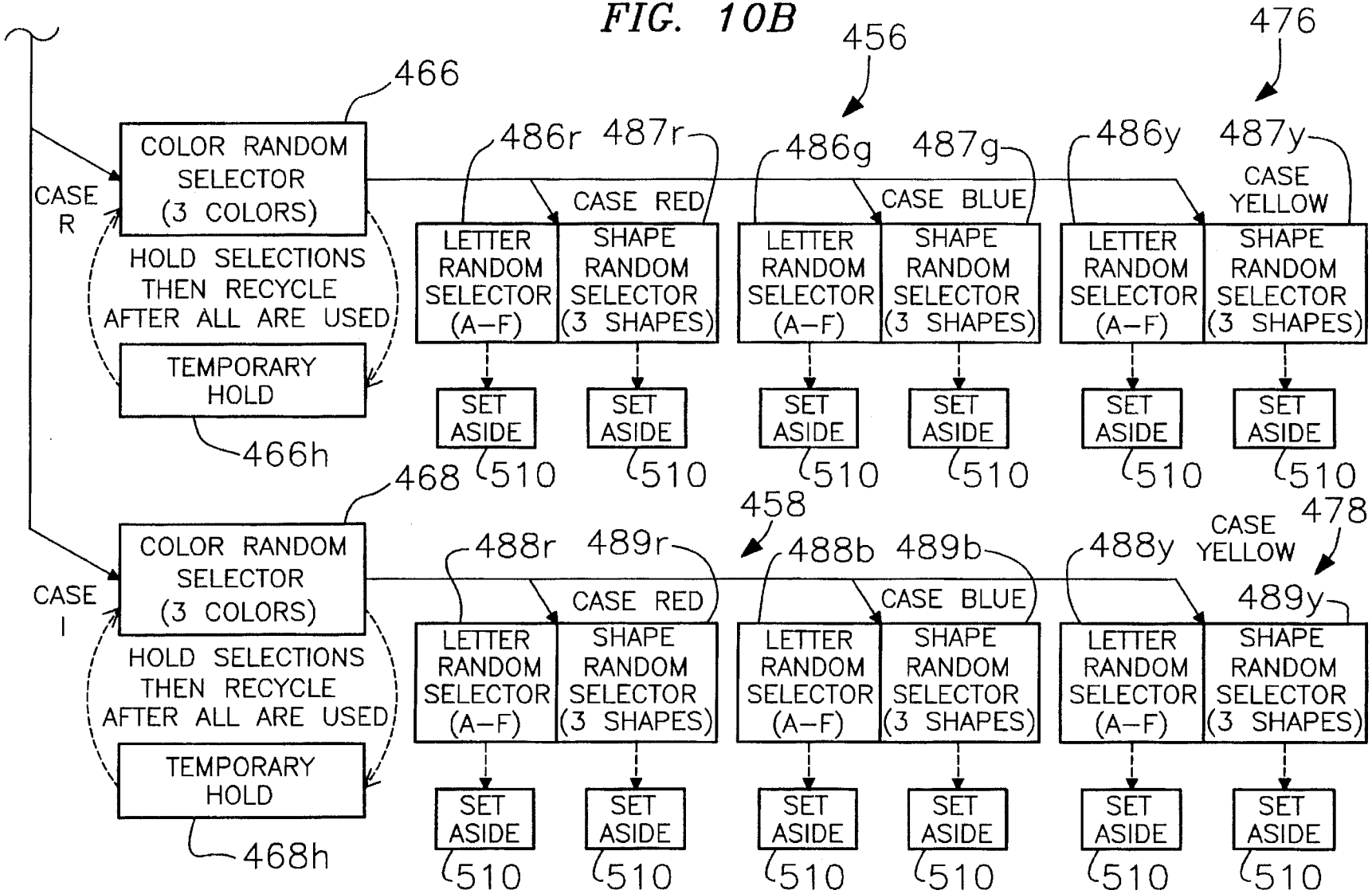

FIG. 10 depicts an alternative random selection apparatus 450, suitable in particular for use in combination with "TRI" game faces, such as the game face 180 of FIG. 5. Thus, the random selection apparatus includes a column random selector 452, employing balls designating just three columns "T", "R" and "I", and three selector sets 454, 456 and 458 corresponding respectively to the three columns "T", "R" and "I". The individual column-corresponding selector sets 454, 456 and 458 in turn include corresponding color random selectors 464, 466 and 468 and respectively associated temporary hold devices 464*h*, 466*h* and 468*h*, corresponding generally to the color random selectors 364, 366 and 368 of FIG. 9, and corresponding second random selectors 474, 476 and 478.

The second random selectors 474, 476 and 478 of FIG. 10 differ from the second random selectors 374, 376, 378, 380 and 382 of FIG. 9 in that, rather than numbers from 1 through 15, individual selector bins select letters A through F. More significantly, in order to accommodate the third set of random variables, namely shapes, the second random selectors 474, 476 and 478 include further individual selector bins for selecting shapes.

Thus the random selector set 474 corresponding to the "T" column of a "TRI" game face includes three individual selector bins 484*r* (for red), 484*b* (for blue) and 484*y* (for yellow), each randomly selecting letters from the set of letters A through F, and each for example designated "Random Selector (A–F)"; and three further individual selector bins 485*r* (for red), 485*b* (for blue) and 485*y* (for yellow), each randomly selecting shapes from the set of shapes "circle", "square" and "diamond", and each for example designated "Shape Random Selector (3 shapes)". During operation, each of the further individual selector bins 485*r*, 485*b* or 485*y* is designated along with the individual selector bin 484*r*, 484*b* or 484*y* of the same color.

Similarly, the random selector set 476 corresponding to the "R" column includes three individual selector bins 486*r*, 486*b* and 486*y*, each randomly selecting letters, and three respectively co-designated further individual selector bins 487*r*, 487*b* and 487*y*, each randomly selecting shapes; and the random selector set 478 corresponding to the "I" column includes three individual selector bins 488*r*, 488*b* and 488*y*, each randomly selecting letters, and three respectively co-designated further individual selector bins 489*r*, 489*b* and 489*y*, each randomly selecting shapes.

To avoid duplicate calls during a game, there are a number of individual "Set Aside" boxes 510, for purposes of example one of each of the selector bins. Balls which are set aside are returned to their appropriate selector bin at the conclusion of a game.

Operation of the "TRI" random selector of FIG. 10 is generally the same as the $PRISM_{15}$ random selector of FIG. 9 except that, after a column and a color have been selected, both a letter and a shape are "called".

Gaming Systems

Figure 11:
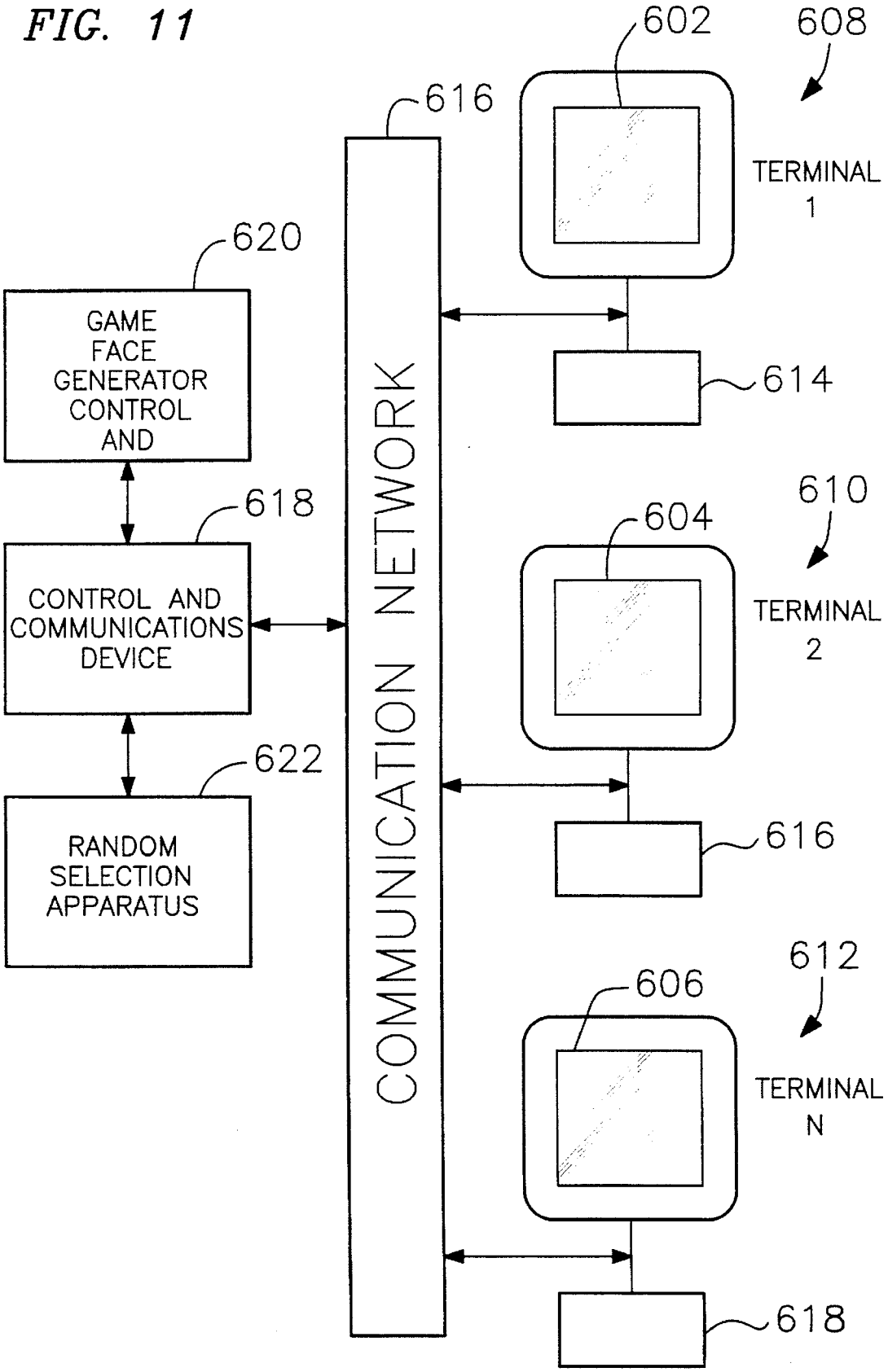
FIG. 11 is a block diagram of a networked gaming system in accordance with the invention.

Referring now to FIG. 11, represented in highly schematic form is a gaming system 600, employing a plurality of game faces as described hereinabove, represented in FIG. 11 by images on a plurality of video displays 602, 604 and 606 included as part of corresponding terminals 608, 610 and 612. Each of the terminals 608, 610 and 612 includes a player input device, 614, 616 and 618. While the player input devices 614, 616 and 618 are shown as separate devices, it will appreciated that these input devices 614, 616 and 618 may be integrated with the video terminal 602, 604 and 606, such as in a conventional "touch screen" terminal.

The terminals 608, 610 and 612 are connected to a communication network 616, which supports interactivity, and may be either dispersed over a wide geographic area, for example employing satellite communications, or may be operating within a single casino hall.

Also connected to the communication network 616 is a control and communications device 618, typically comprising an appropriately-programmed computer, coordinating the operations of a game face generator 620, corresponding to the game face generator 202, and of a random selection apparatus 622, corresponding to the random selection apparatus 350 or 450 of FIG. 9 or FIG. 10. In the FIG. 11 embodiment, rather than airball machines, the random selection apparatus 622 comprises electronic random number generators. In a typical implementation, the controls and communications device 618, the game face generator 620, and the random selection apparatus 622 all comprise elements of a single, appropriately-programmed comprehensive computer system.

Game Variations

The game system of the invention is subject to wide variations in implementation, without departing from the scope of the invention.

Figure 12:
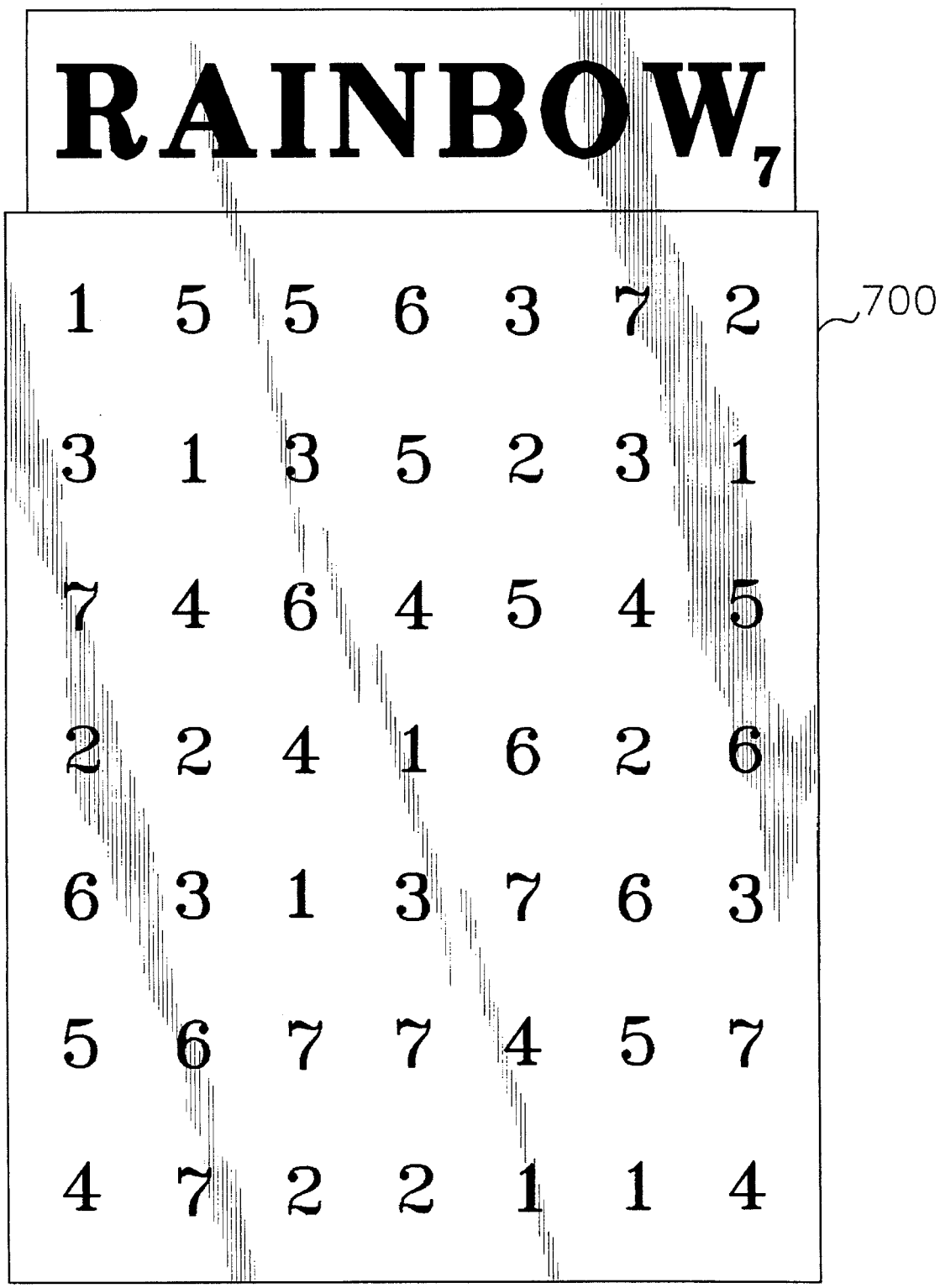
FIG. 12, wherein symbols are employed to indicate colors, depicts a partial game face, having numbers only, which is part of an implementation whereby a game player can "customize" a game face.
Figure 13:
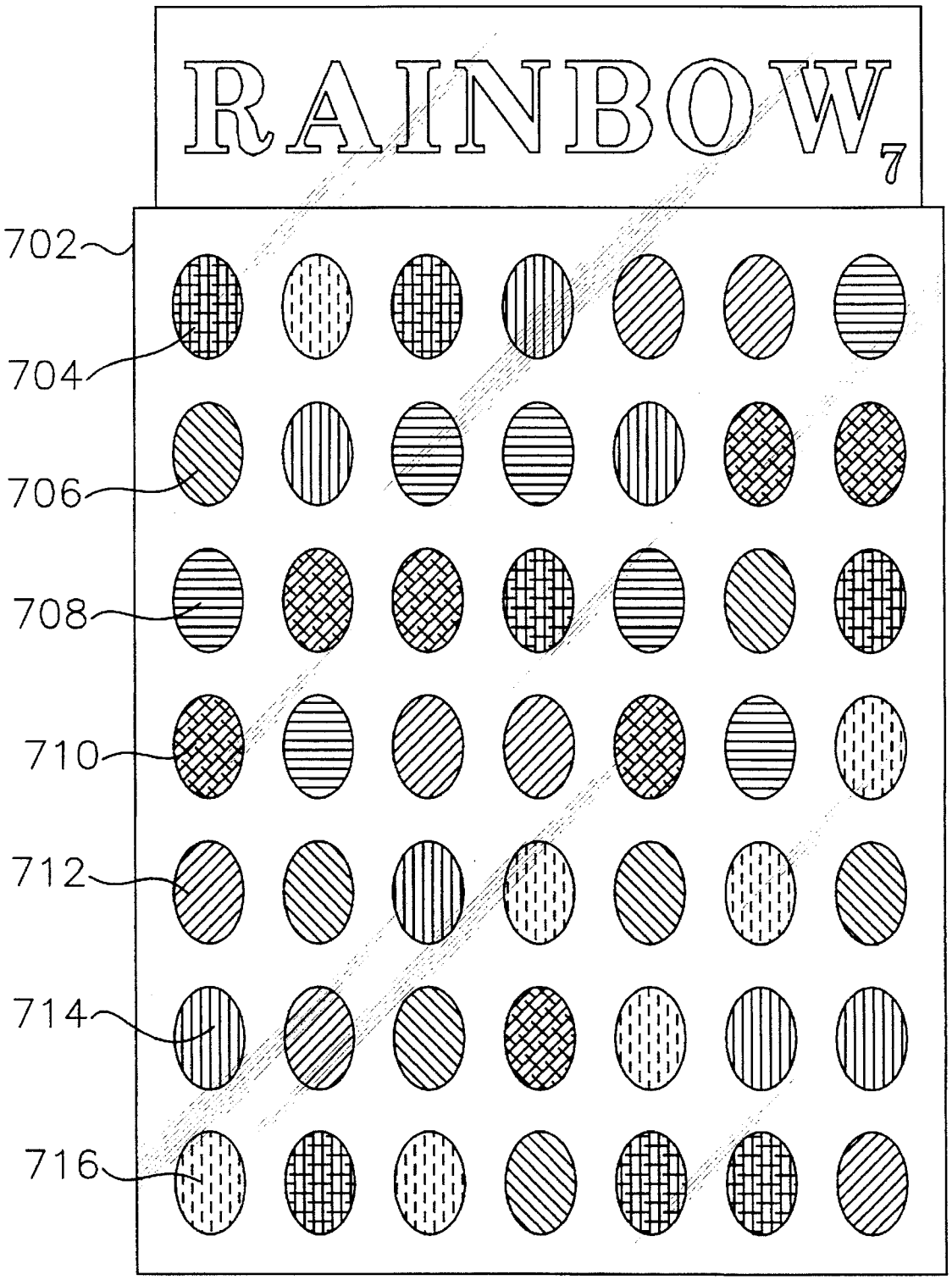
FIG. 13, wherein symbols are employed to indicate colors, is another partial game face, having colors only, which may be a transparent overlay and which compliments the partial game face of FIG. 12.

As an illustration of the flexibility provided by the use of multiple random variables, FIGS. 12 and 13 represent a variation on $RAINBOW_7$ wherein a player is able to "customize" a game face in order to achieve a perceived "lucky" game face.

FIG. 12 more particularly represents a randomly-developed game face base 700, such as a piece of paper, having printed thereon randomly-selected numbers in accordance with the rules of $RAINBOW_7$. The FIG. 12 game face base 700, however, lacks colors, accordingly has only one set of random variables, and thus is not used by itself.

FIG. 13 provides another set of random variables, namely colors, in the form of a transparent overlay 702, which is placed over the game face base 700, to produce a resultant game face combining a number and a color in each position. Such an arrangement in some circumstances is more attractive to players. Describing the exemplary colors employed in FIG. 7, in the first or "R" column position 704 is "Yellow", position 706 is "green", position 708 is "blue", position 710 is "orange", position 712 is "brown", position 714 is "red" and position 716 is "violet". The remaining positions on the overlay 702 are filled with colors as indicated.

Although the number-bearing element depicted in FIG. 12 is described as a game face base, and the color-bearing element of FIG. 3 is described as a transparent overlay, it will be appreciated that the same result is obtained if the color-bearing element of FIG. 13 is the game face base, and the number-bearing element of FIG. 12 is formed as a transparent overlay.

Figure 14:
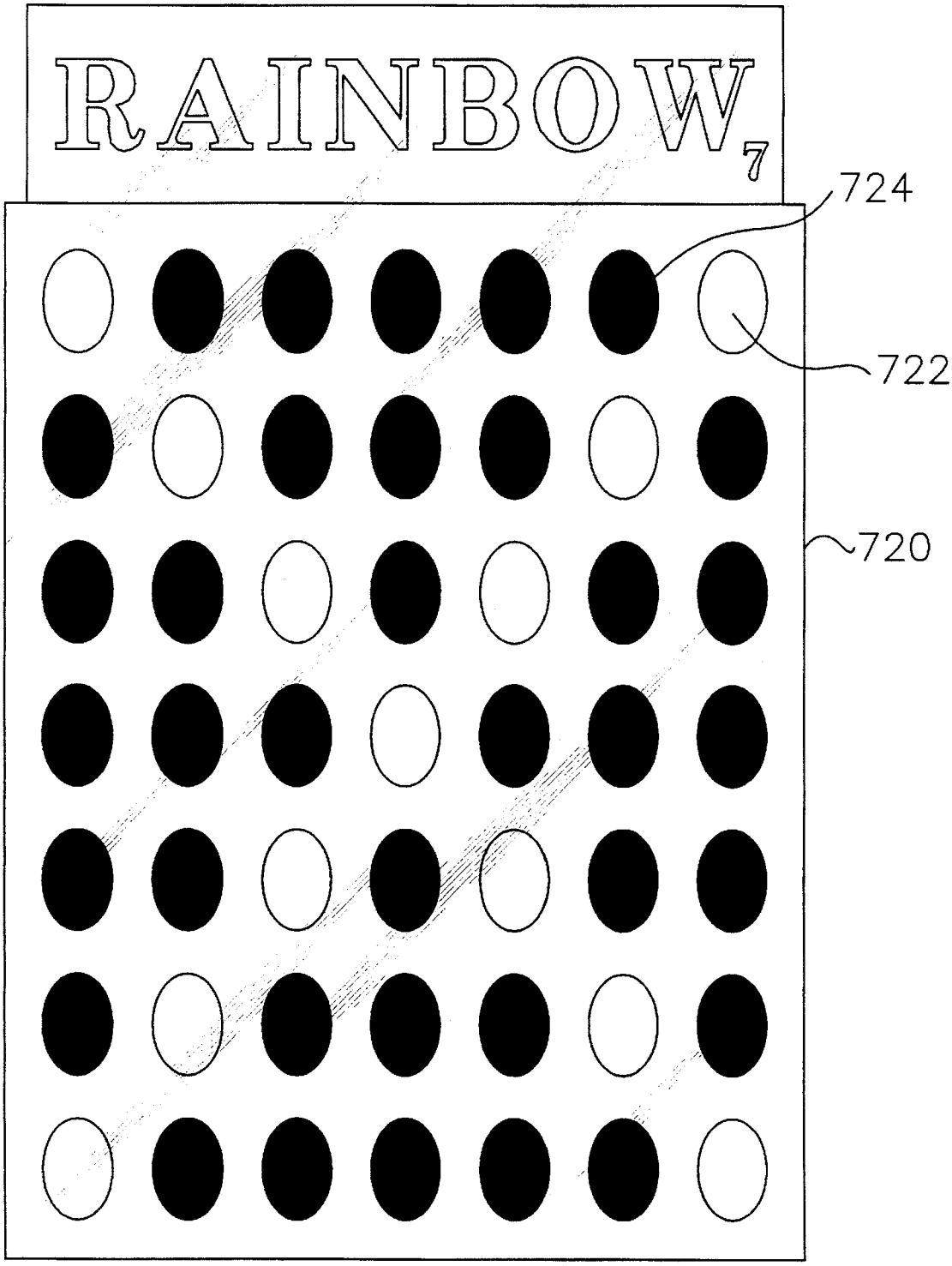
FIG. 14, wherein symbols are employed to indicate colors, is one form of a pattern overlay for a $RAINBOW_7$ implementation.
Figure 15:
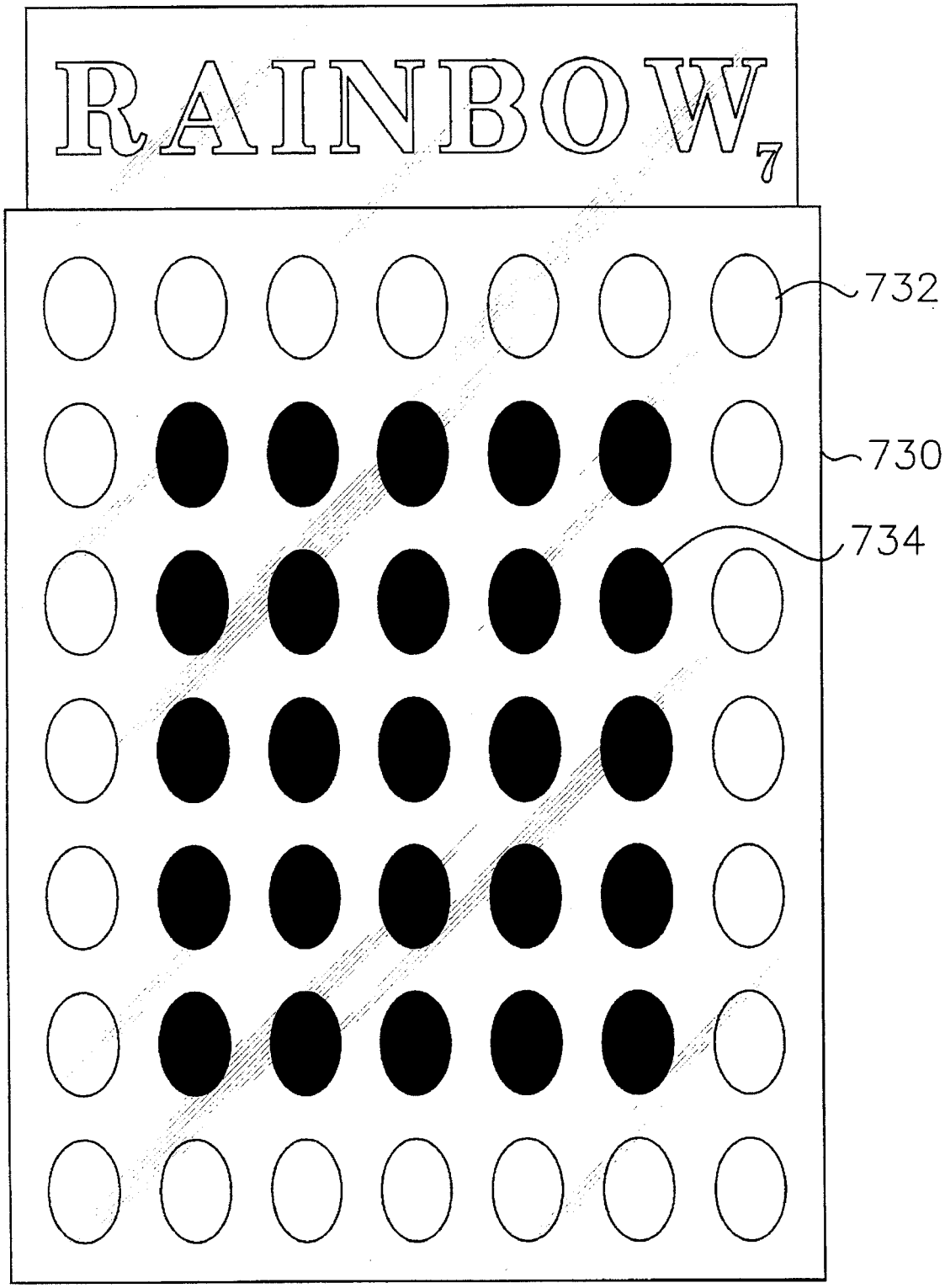
FIG. 15, wherein symbols are employed to indicate colors, is another pattern overlay for a $RAINBOW_7$ implementation.

FIGS. 14 and 15 illustrate two different pattern masks 720 and 730, generally transparent but with respective sets of opaque areas 724 and 734 (with the symbol for "black"), which may be employed in games of $RAINBOW_7$ in order to indicate a winning pattern combination. the remaining respective sets of areas 722 and 732 are clear, so that the underlying colors and numbers during use are visible.

In the case of the FIG. 14 pattern overlay 720, a winning pattern is an "X". In the case of the FIG. 15 pattern overlay 730, a winning pattern is a "frame".

Figure 16:
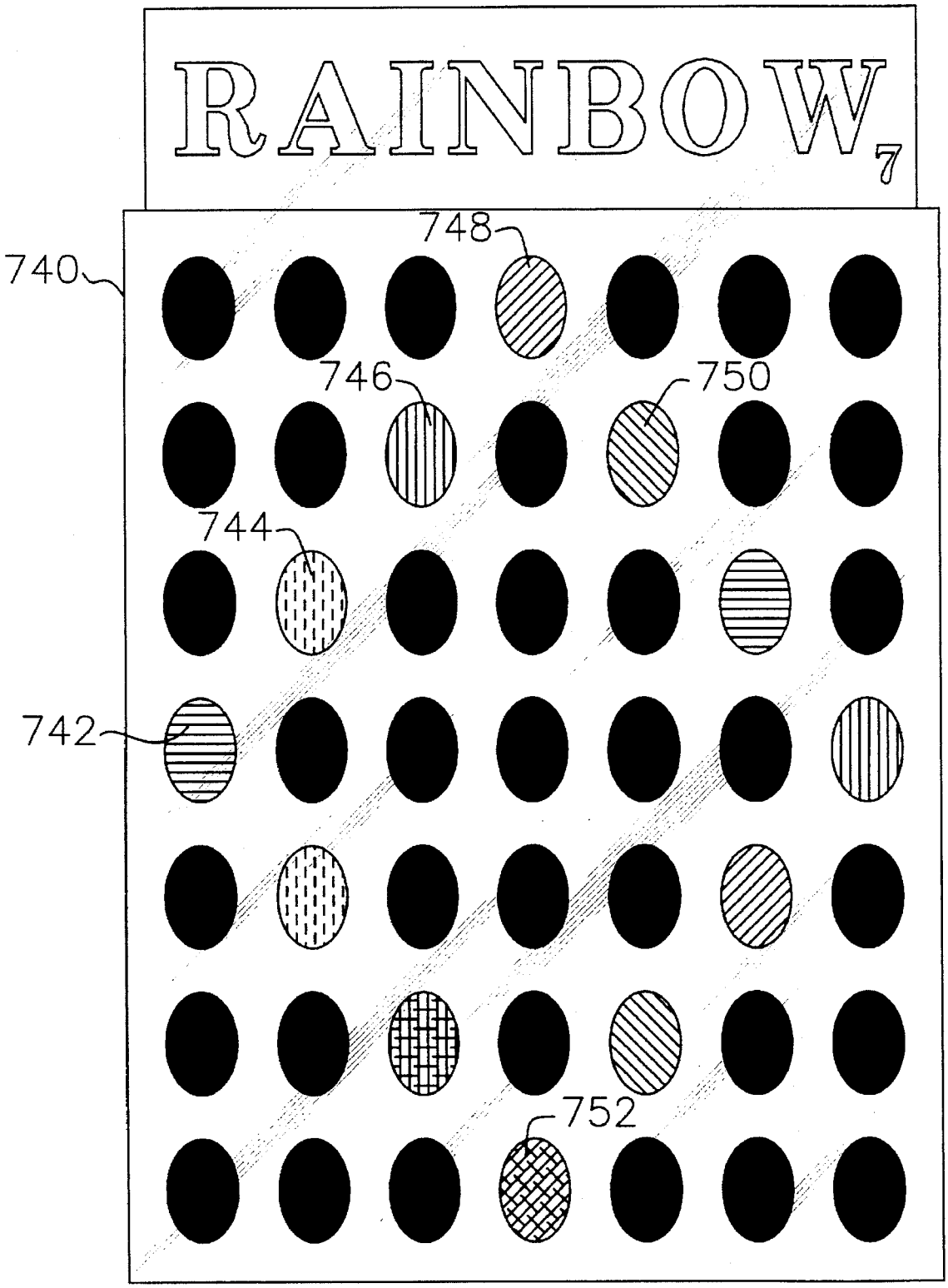
FIG. 16, wherein symbols are employed to indicate colors, is yet another pattern overlay, likewise for a RAINBOW$_7$ implementation, which overlay also combines colors.

Referring finally to FIG. 16, depicted is yet another pattern overlay 740, which combines winning colors with a pattern. Thus, in FIG. 16 the winning pattern is a diamond. Exemplary colors are described as follows: position 742 is "blue", position 744 is "violet", position 746 is "red", position 748 is "brown", position 750 is "green", position 752 is "orange", and the remaining positions are "black" or opaque. For an increased payout, or even to win at all depending on the particular game, the colors must match as well. The color and pattern overlay of FIG. 16 may be employed in combination with the game face base 700 of FIG. 12 instead of the transparent overlay 702 of FIG. 13.

Instant Ticket Versions

The invention may be implemented in instant ticket versions wherein game tickets are pre-printed in sets that have a number of pre-determined winning tickets. Included with each set is a list of all ticket combinations as well as the winning combinations. Winning combinations can be pre-selected from many combinations. Example: in PRISMS (5×5) only one horizontal column is printed on an Instant Ticket. A winning combination may be five number and color combinations that are all the same, or five colors are the same with sequential numbers, or the same number combined with five different colors. The number of predetermined winning combinations used is determined by how many tickets are going to be in a set (and by how many winners may be required in fund raising). In YES and TRI versions the entire card face may be used in a Scratch-off Instant and the player may only scratch off four of the nine spaces to try to win. In Scratch-off Instant there are a predetermined number of "potential" winning tickets. In most Instant Ticket Games, 3, 4, or 5 of a kind are considered winners. In games using multiple variables there are more possible winning combinations to select from. Therefore, larger sets of Instant Tickets can be printed. Such Instant Tickets may be used for sports lotteries to raise money to support city teams without raising local taxes and ticket prices to build or repair stadiums (people at home could also participate).

"Matching" Versions

Games such as "TRI" and "YES" may be implemented in "matching" versions particularly for video arcade play that do not required any "callers" or "marking". The color/symbol/indicia are selected by the player. Then the system jumbles the selections. Players must match (timed/scored) the computers/game screens' placement of color/symbol/indicia as they individually appear on the screen (3×3 frame is "flashed" periodically for only a few seconds). A players' score depends on how many "first try", "second try", "third try" placements are completed within a specific amount of time.

There are also "hidden" versions of several of the games designed for children's home play and arcade play. In these variations symbol/color/indicia appear in "picture scenes" and characters. The players collect these sets of symbols and place them in treasure chest sets, and players must complete a pre-disclosed set in order to win. Some home versions are played by using special card decks and placing their special mark on a shared board, covering only the selections that are drawn by them on their turn. The deck contains steal a space/wild cards/lose a turn/skip/draw again/reverse play, etc. cards as well as the space I.D. possibility cards.

"Satellite" Implementations

As will be apparent from the foregoing, the game systems of the invention are capable of a wide variety of implementations. Since the multiple variable aspect of the invention accommodates a large number of players, the invention may be implemented in "satellite" versions wherein game calls are transmitted by way of television broadcast from a central location, and individual game players play at their homes, for example, employing appropriate terminal equipment.

The games are organized through an appropriate entity, such as a broadcast company, a cable television company, a satellite television broadcast company, or other appropriate entities.

Transmissions of the broadcast games from the company to the players are viewed on an ordinary television set. Transmissions from the players to the company, employing the terminal equipment, are via telephone line, local interactive cable connection, or other suitable means.

Individual players upon registration are assigned identification (I.D.) numbers, and each player maintains a pay-for-play account with the company. Such registration of players legitimatizes the game interaction, and verifies that the player is of legal age, is properly registered with a bank (e.g. with a debit and credit account), and is reporting annual profit and loss for tax and related purposes. Statements may be rendered by the company on a regular basis, for example, monthly. Each player upon registration is issued an identification card, which bears the player's registration number in machine-readable form, for example employing a bar code.

Game face cards are pre-printed and distributed through appropriate outlets. For computerized identification purposes, individual card faces are appropriately coded in machine-readable form, for example also employing bar codes, for verification purposes.

The debit and credit account may be networked through an existing banking system, which would be a service offered for a monthly fee.

During use, each player, by means of his terminal equipment, is able to "log on" to the broadcast games at any time. The terminal equipment includes a reader for reading the individual player's registration card, as well as the serial number code assigned to the individual game face for verification of winning games.

With this system, various non-profit organizations, Indian nations, government lotteries and so on can contract with the company or other controlling entity, the players and the bank. The use of licensed entities with appropriate controls can ensure compliance with applicable laws.

Conclusion

In view of the foregoing, it will be appreciated that the present invention provides improved bingo-like game systems with advantageous characteristics, but which may have an arrangement of columns and rows on the card faces which resembles ordinary bingo, and can be played in a manner similar to ordinary bingo, with the result that the game of bingo is enhanced and improved, without complicating the game for the player. Thus, for example, for a typical 5×5 version, instructions are: "mark the number (as in bingo), but only if it is the called color and is in the called column."

A significant limitation of ordinary bingo that is overcome by the invention is the limitation on the number of players which may be accommodated at one time without an excessive number of "repeat" winners, and without unduly short games.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. Game equipment comprising:

a plurality of game faces, each game face having a plurality of individual positions organized as m rows by n columns, where m is an integer and n is an integer greater than one; and within each column of each of said game faces the individual positions are filled with a random sequence of elements from each of at least two sets of different entities.

2. Game equipment in accordance with claim 1, further comprising a unique column designation for each column of said game faces.

3. Game equipment in accordance with claim 1, wherein m=n=5.

4. Game equipment in accordance with claim 1, wherein m=n=7.

5. Game equipment in accordance with claim 1, wherein, within each column of each of said game faces, no element from any of said at least two sets is repeated.

6. Game equipment in accordance with claim 1, wherein said game faces comprises pre-printed game tickets.

7. Game equipment in accordance with claim 1, wherein said game faces comprise game tickets printed on demand on-site.

8. Game equipment in accordance with claim 1, wherein said game faces comprise images on a networked video display terminal.

9. Game equipment in accordance with claim 1, wherein said game faces comprise images on a networked electronic game board.

10. Game equipment in accordance with claim 1, wherein one of said sets comprises colors and another one of said sets comprises symbols.

11. Game equipment in accordance with claim 10, wherein said set of symbols comprises numbers.

12. Game equipment in accordance with claim 10, wherein said set of symbols comprises letters.

13. Game equipment in accordance with claim 10, wherein m=n and wherein said set of symbols comprises an integer multiple of m different elements.

14. Game equipment in accordance with claim 10, wherein m=n and wherein said set of colors comprises m different colors.

15. Game equipment in accordance with claim 10, wherein yet another one of said sets comprises geometric shapes.

16. Game equipment in accordance with claim 15, wherein m=n=3, wherein said set of colors comprises three different colors, wherein said set of symbols comprises six different symbols, and wherein said set of geometric shapes comprises three different shapes.

17. Game equipment in accordance with claim 1, further comprising random selection apparatus for generating a sequence of calls, each call specifying an element from each of said at least two sets of different entities such that a game player can designate individual positions on a particular game face which have elements that match specified elements of a particular call, said random selection apparatus comprising:

at least one selector set including:

a first random selector for randomly selecting a sequence of elements from a first one of said sets without repeating any element until all elements of said first one of said sets are selected; and a second random selector organized as individual selector bins corresponding respectively to the elements of said first one of said sets, each of said individual selector bins randomly selecting a sequence of elements from a second one of said sets as that individual selector bin is designated by the selection by said first random selector of a corresponding element from said first one of said sets.

18. Game equipment in accordance with claim 17, wherein said second random selector has further individual selector bins corresponding respectively to the elements of said first one of said sets, each of said further individual selector bins randomly selecting a sequence of elements from a third one of said sets as that further individual selector bin is designated, along with corresponding individual selector bin, by the selection by said first random selector of a corresponding element from said first one of said sets.

19. Game equipment in accordance with claim 17, wherein each of said individual selector bins randomly selects a sequence of elements from said second one of said sets without repeating any element during a game.

20. Game equipment in accordance with claim 18, wherein each of said further individual selector bins randomly selects a sequence of elements from said third one of said sets without repeating any element during a game.

21. Game equipment in accordance with claim 17, which comprises n selector sets corresponding respectively to the columns of said game faces.

22. Game equipment in accordance with claim 21, which further comprises a column random selector for randomly selecting a sequence of columns for designating an order of said selector sets.

23. Game equipment in accordance with claim 17, wherein said random selectors comprise air ball machines.

24. Game equipment in accordance with claim 17, wherein said random selectors comprise spinners.

25. Game equipment in accordance with claim 17, wherein said random selectors comprise electronic random number generators.

26. Random selection apparatus for generating a sequence of calls for use with a plurality of game faces, each game face having a plurality of individual positions organized as m rows by n columns, where m is an integer and n is an integer greater than one, and within each column of each of the game faces the individual positions are filled with a sequence of elements from each of at least two sets of different entities, each call specifying an element from each of the at least two sets of different entities such that a game player can designate individual positions on a particular game face which have elements that match specified elements of a particular call, said random selection apparatus comprising:

at least one selector set including:

a first random selector for randomly selecting a sequence of elements from a first one of said sets without repeating any element until all elements of said first one of said sets are selected; and a second random selector organized as individual selector bins corresponding respectively to the elements of said first one of said sets, each of said individual selector bins randomly selecting a sequence of elements from a second one of said sets as that individual selector bin is designated by the selection by said first random selector of a corresponding element from said first one of said sets.

27. Random selection apparatus in accordance with claim 26, wherein said second random selector has further individual selector bins corresponding respectively to the elements of said first one of said sets, each of said further individual selector bins randomly selecting a sequence of elements from a third one of said sets as that further individual selector bin is designated, along with corresponding individual selector bin, by the selection by said first random selector of a corresponding element from said first one of said sets.

28. Random selection apparatus in accordance with claim 26, wherein each of said individual selector bins randomly selects a sequence of elements from said second one of said sets without repeating any element during a game.

29. Random selection apparatus in accordance with claim 27, wherein each of said further individual selector bins randomly selects a sequence of elements from said third one of said sets without repeating any element during a game.

30. Random selection apparatus in accordance with claim 26, which comprises n selector sets corresponding respectively to the columns of said game faces.

31. Random selection apparatus in accordance with claim 30, which further comprises a column random selector for randomly selecting a sequence of columns for designating an order of said selector sets.

32. Random selection apparatus in accordance with claim 26, wherein said random selectors comprise air ball machines.

33. Random selection apparatus in accordance with claim 26, wherein said random selectors comprise spinners.

34. Random selection apparatus in accordance with claim 26, wherein said random selectors comprise electronic random number generators.

35. A system for generating game faces, each game face having a plurality of individual positions organized as m rows by n columns, where m is an integer and n is an integer greater than one, said system comprising:

a memory storing elements of at least two sets of predefined entities; and a random position-filling device for, within each column of a game face, filling the individual positions with a random sequence of elements from each of said at least two sets of predefined entities.

36. The system of claim 35, wherein said random position-filling device ensures that, within each column of a game face, no element from any of said at least two sets is repeated.

37. The system of claim 35, which includes a printer for printing game faces in hard copy form.

38. The system of claim 35, which includes a networked video display terminal for presenting a generated game face.

39. The system of claim 35, which includes a networked electronic game board for presenting a generated game face.

40. The system of claim 35, which is accessible by an individual game player for on-site generation of a game face.

41. The system of claim 40, wherein said random position-filling device allows the individual game player to choose an element from each of said at least two sets for first position in each column.

42. The system of claim 41, wherein said random position-filling device ensures that, within each column of a game face, no element from any of said at least two sets is repeated.

43. The system of claim 35, wherein one of said sets comprises colors and another one of said sets comprises symbols.

44. The system of claim 43, wherein said set of symbols comprises numbers.

45. The system of claim 43, wherein said set of symbols comprises letters.

46. The system of claim 43, wherein m=n and wherein said set of symbols comprises an integer multiple of m different elements.

47. The system of claim 43, wherein m=n and wherein said set of colors comprises m different colors.

48. The system of claim 43, wherein yet another one of said sets comprises geometric shapes.

49. The system of claim 48, wherein m=n=3, wherein said set of colors comprises three different colors, wherein said set of symbols comprises six different symbols, and wherein said set of geometric shapes comprises three different shapes.

50. The system of claim 35, wherein m=n=5.

51. The system of claim 35, wherein m=n=7.

52. The system of claim 35, further comprising a version controller allowing an individual game player to select values of m and n.

53. A gaming employing a plurality of game faces, each game face having a plurality of individual positions organized as m rows by n columns, where m is an integer and n is an integer greater than one, said gaming apparatus comprising:

a game face generator, including a memory storing elements of at least two sets of predefined entities, and a random position-filling device for, within each column of a game face, filling the individual positions with a random sequence of elements from each of said at least two sets of predefined entities; and random selection apparatus for generating a sequence of calls, each call specifying an element from each of said at least two sets of different entities such that a game player can designate individual positions on a particular game face which have elements that match specified elements of a particular call, said random selection apparatus comprising:

at least one selector set including:

a first random selector for randomly selecting a sequence of elements from a first one of said sets without repeating any element until all elements of said first one of said sets selected; and a second random selector organized as individual selector bins corresponding respectively to the elements of said first one of said sets, each of said individual selector bins randomly selecting a sequence of elements from a second one of said sets as that individual selector bin is designated by the selection by said first random selector of a corresponding element from said first one of said sets.

54. The gaming apparatus of claim 53, wherein said second random selector has further individual selector bins corresponding respectively to the elements of said first one of said sets, each of said further individual selector bins randomly selecting a sequence of elements from a third one of said sets as that further individual selector bin is designated, along with corresponding individual selector bin, by the selection by said first random selector of a corresponding element from said first one of said sets.

* * * * *